US005584337A

United States Patent [19]

Nakashima et al.

[11] Patent Number: 5,584,337

[45] Date of Patent: Dec. 17, 1996

[54] PROCESS FOR PRODUCING THIN CAST STRIP

[75] Inventors: Hiroyuki Nakashima; Hideki Oka, both of Hikari; Hidemaro Takeuchi, Futtsu; Shigenori Tanaka; Yoshimori Fukuda, both of Hikari; Satoshi Akamatsu, Futtsu; Masafumi Miyazaki, Hikari; Yoshikazu Matsumura, Kitakyusyu, all of Japan

[73] Assignee: Nippon Steel Corporation, Tokyo, Japan

[21] Appl. No.: 553,306

[22] PCT Filed: Mar. 24, 1995

[86] PCT No.: PCT/JP95/00549

§ 371 Date: Nov. 21, 1995

§ 102(e) Date: Nov. 21, 1995

[87] PCT Pub. No.: WO95/26242

PCT Pub. Date: Oct. 5, 1995

[30] Foreign Application Priority Data

| | | | |
|---|---|---|---|
| Mar. 25, 1994 | [JP] | Japan | 6-055835 |
| Mar. 25, 1994 | [JP] | Japan | 6-055977 |
| Apr. 4, 1994 | [JP] | Japan | 6-066174 |
| Apr. 5, 1994 | [JP] | Japan | 6-067201 |

[51] Int. Cl.[6] ..... B22D 11/22

[52] U.S. Cl. ..... 164/477; 164/476

[58] Field of Search ..... 164/476, 477; 148/540, 541, 546

[56] References Cited

FOREIGN PATENT DOCUMENTS

| | | | |
|---|---|---|---|
| 59-199152A | 11/1984 | Japan . | |
| 63-30159A | 2/1988 | Japan . | |
| 2-133528A | 5/1990 | Japan . | |
| 4-14171B | 3/1992 | Japan . | |
| 5-25548 | 2/1993 | Japan | 148/541 |

*Primary Examiner*—Kuang Y. Lin
*Attorney, Agent, or Firm*—Kenyon & Kenyon

[57] ABSTRACT

In continuous casting a thin carbon cast strip, the scale formed thereon is made thin and made to have a composition suited to working such as cold rolling and pressing. Moreover, an apparatus for inhibiting scale formation is simplified, and the consumption amount of an inert gas is reduced. The cast strip is thus produced efficiently. A carbon steel containing up to 0.5% of C is cooled and solidified by a pair of cooling drums to give a thin cast strip having a thickness up to 10 mm. The cast strip is introduced into a seal chamber, where the strip is held in an Ar gas atmosphere containing up to 5% of oxygen through a temperature region to at least 1,200° C., and the strip is cooled at a rate of at least 10° C./sec through a temperature region to 750° to 800° C., followed by coiling the strip in a coil form with a coiler at a temperature of at least 500° C. and up to 800° C. Furthermore, the atmosphere is formed with a nitrogen gas or exhaust gas. The scale formation is inhibited, and the composition of the scale is controlled by the use of the atmosphere.

10 Claims, 13 Drawing Sheets

PROCESS FOR PRODUCING THIN CAST STRIP

FIELD OF THE INVENTION

The present invention relates to a process for producing a thin cast strip of carbon steel by a continuous casting machine in which the mold walls are moved in synchronization with the cast strip, and particularly relates to the process wherein the properties of scale formed on the cast strip are controlled

BACKGROUND OF THE INVENTION

A twin drum continuous casting machine, for example, is known as a continuous casting machine in which the mold walls are moved in synchronization with the cast strip. The machine is an apparatus for casting a thin cast strip, wherein a pouring basin of molten steel is formed by a pair of cooling drums each rotating in a direction opposite to that of the other drum and a pair of side gates applied to the respective ends of a pair of the cooling drums by pushing, a molten steel is supplied to the pouring basin, the molten steel is cooled and solidified along the peripheral surface of the cooling drums to form solidified shells, and the solidified shells are united in the gap between the cooling drums.

When a carbon steel containing up to 5% of C is cast into a thin cast strip having a thickness up to 10 mm by such a continuous casting machine, a thick scale containing FeO as its main component is formed on the cast strip surface. When a cast strip on which such a scale is formed is pickled, a rough surface appears. When such a cast strip is cold rolled, defects such as scab are formed on the cold rolled steel sheet, and the surface properties of the products are markedly impaired. Moreover, when the cast strip on which such a scale is formed is press worked or bent, there arises a problem that the scale is peeled off to impair the surface properties of the products.

There has heretofore been known a method as, for example, disclosed in Japanese Unexamined patent publication (Kokai) No. 59-199152, for completely inhibiting scale formation on a cast strip in twin drum type continuous casting, which method comprises transferring a cast strip sent from cooling drums along rolls in an inert atmosphere in a seal chamber, which is provided so that it surrounds the casting machine, to cool the strip to a temperature of up to 150° C.

However, since the casting rate of the twin drum continuous casting machine is as fast as about 80 m/min, holding the cast strip in an inert atmosphere until the strip temperature becomes up to 150° C. causes problems that a long and large cooling apparatus is required, that the productivity becomes poor, and that a large amount of inert gas is consumed.

BACKGROUND OF THE INVENTION

The present invention is intended to make the scale formed on a cast strip thin in continuous casting a thin carbon steel strip, and also make the composition of the scale suited to working such as cold rolling and pressing after continuous casting.

Furthermore, the present invention is intended to simplify an apparatus for inhibiting the formation of scale on a cast strip, reduce the consumption of the inert gas and efficiently produce cast strips.

As described below is the subject matter of the process for producing a thin cast strip of the present invention which process solves the problems as mentioned above.

(1) In a process for producing a thin cast strip wherein a carbon steel comprising up to 0.5% of C and less than 0.1% of Cr or Cu is cast into a thin cast strip having a thickness up to 10 mm by a continuous casting machine having mold walls which move in synchronization with the cast strip, and the thin cast strip is coiled in a coil form by a coiler, a process for producing a thin cast strip with a reduced surface scale which comprises the steps of holding the thin cast strip, subsequently to casting into the strip, in an atmosphere comprising up to 5.0% of oxygen and the balance an inert gas through a temperature region to up to 1,200° C., then cooling the cast strip at a rate of at least 10° C./sec through a temperature region to 800° to 750° C., and coiling the cast strip in a coil form by the coiler.

(2) The process for producing a thin cast strip according to (1) which has a scale further excellent in the ability of being descaled, wherein Ar is used as the inert gas, and the cast strip is cooled through the temperature region to 800° C. at a rate of at least 10° C./sec, subsequently to the holding procedure in the gas atmosphere.

(3) The process for producing a thin cast strip according to (1) which has a scale further excellent in the ability of being descaled, wherein Ar is used as the inert gas, the cast strip is cooled through the temperature region to 800° C. at a rate of at least 10° C./sec, subsequently to the holding procedure in the gas atmosphere, and the thin cast strip is coiled in a coil form by the coiler at a coiling temperature of at least 500° C. and up to 800° C.

(4) The process for producing a thin cast strip according to (1) which has a scale further excellent in press peeling-resistant properties, wherein nitrogen is used as the inert gas, and the cast strip is cooled through a temperature region to 750° C. at a rate of at least 10° C./sec, subsequently to the holding procedure in the gas atmosphere.

(5) The process for producing a thin cast strip according to (1) which has a scale further excellent in press peeling-resistant properties, wherein nitrogen is used as the inert gas, the cast strip is cooled through a temperature region to 750° C. at a rate of at least 10° C./sec, subsequently to the holding procedure in the gas atmosphere, and the thin cast strip is coiled in a coil form by the coiler at a temperature up to 600° C.

(6) The process for producing a thin cast strip according to (1) which has a scale further excellent in press peeling-resistant properties, wherein an exhaust gas having a dew point up to 40° C. is used as the inert gas, and the cast strip is cooled through a temperature region to 750° C. at a rate of at least 10° C./sec, subsequently to the holding procedure in the gas atmosphere.

(7) The process for producing a thin cast strip according to (1) which has a scale further excellent in press peeling-resistant properties, wherein an exhaust gas having a dew point up to 40° C. is used as the inert gas, the cast strip is cooled through a temperature region to 750° C. at a rate of at least 10° C./sec, subsequently to the holding procedure in the gas atmosphere, and the thin cast strip is coiled in a coil form by the coiler at a temperature of up to 600° C.

(8) In a process for producing a thin cast strip wherein a carbon steel comprising up to 0.5% of C and at least 0.1% of Cr or Cu is cast into a thin cast strip having a thickness of up to 10 mm by a continuous casting machine having mold walls which move in synchronization with the cast strip, and the thin cast strip is coiled in a coil form by a coiler, a process for producing a thin cast strip with a reduced surface scale which comprises the steps of holding the thin cast strip, subsequently to casting into the cast strip, in an atmosphere comprising up to 7.0% of oxygen and the balance an inert gas through a temperature region to up to 1,200° C., then cooling the cast strip at a rate of at least 10° C./sec through a temperature region to 750° C., and coiling the cast strip in a coil form by a coiler.

(9) The process for producing a thin cast strip according to (8) which has a scale further excellent in press peeling-resistant properties, wherein nitrogen is used as the inert gas.

(10) The process for producing a thin cast strip according to (8) which has a scale further excellent in press peeling-resistant properties, wherein nitrogen is used as the inert gas, and the thin cast strip is coiled in a coil form by the coiler at a temperature up to 600° C.

BEST MODE FOR CARRYING OUT THE INVENTION

When a cast strip subsequent to continuous casting having a temperature exceeding 1200° C. is exposed to the air, nitrogen in the air enriches the cast strip surface, and an $Fe_3O_4$ scale which is difficult to peel off is formed thereon. In contrast to the above procedure, in a first aspect to a third aspect of the present invention, a cast strip subsequent to continuous casting having a temperature in a region to up to 1,200° C. is held in an Ar gas atmosphere having an oxygen concentration up to 5%, and nitrogen does not enrich the cast strip surface. As a result, the scale composition becomes FeO which can be easily peeled off, and the scale has a thickness of up to 10 μm. Since the scale can be easily peeled off, the cast strip is very easily descaled, and the surface roughness of the cast strip is small, after pickling.

When the cast strip is cooled, subsequently to the holding procedure in an Ar gas atmosphere, through a temperature region to 800° C. at a rate of at least 10° C./sec, scale formation in the temperature region is inhibited, and the scale thickness can be suppressed to a thickness of up to 10 μm. When the cast strip on which the scale has been formed is pickled, the scale does not remain because the scale is readily peeled off. Moreover, since the cast strip has a low surface roughness, it has surface properties excellent in smoothness after cold rolling.

After the procedures mentioned above, the cast strip is coiled in a coil form by a coiler at a temperature of at least 500° C. and up to 800° C. The formation of $Fe_3O_4$ is then inhibited at the interface between the cast strip surface and the scale, and the scale contains FeO as its main component and has a suppressed thickness up to 10 μm.

Figure 1:
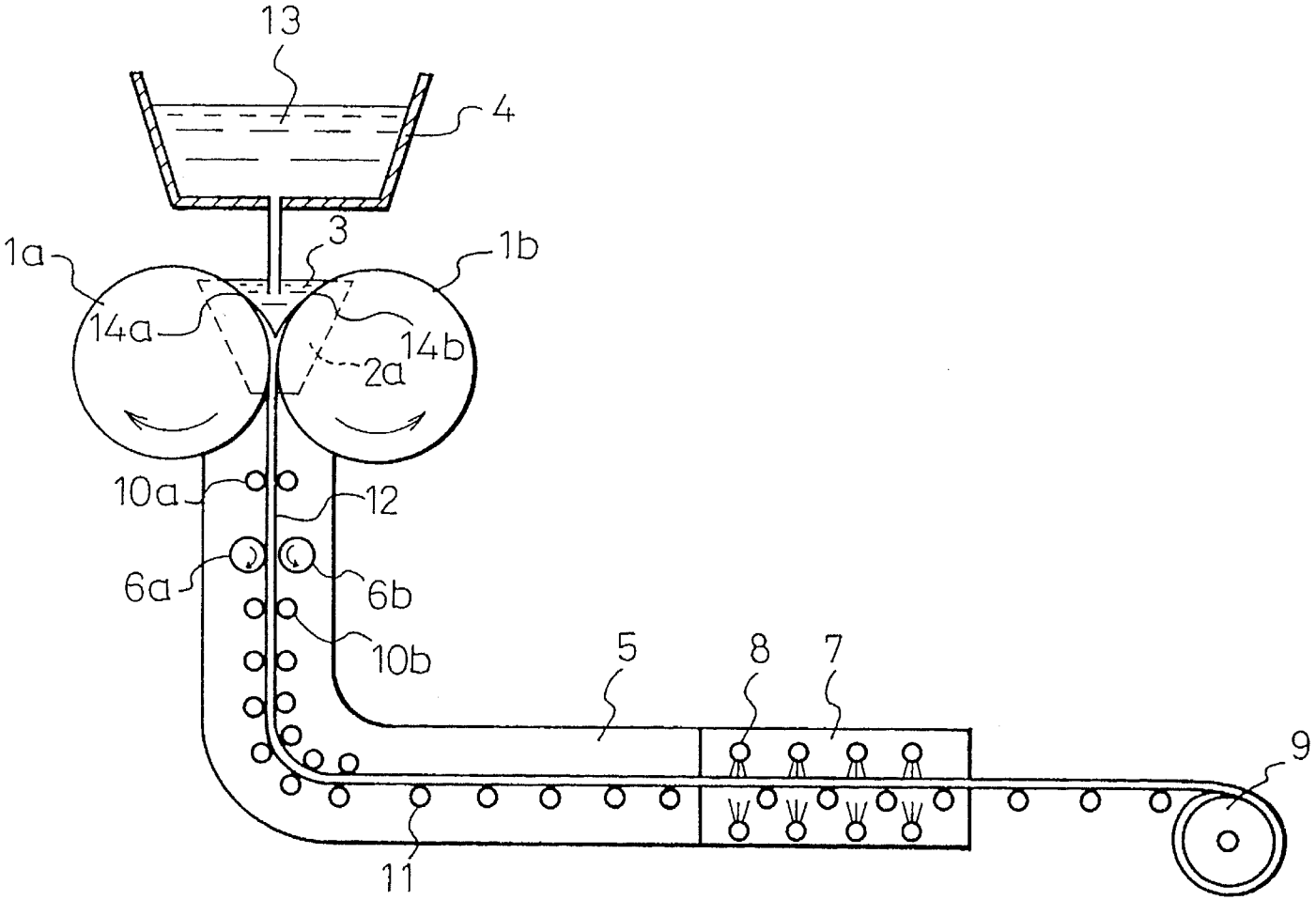
FIG. 1 is a schematic plan view of a twin drum continuous casting machine for practicing the present invention.

FIG. 1 shows a twin drum continuous casting machine for practicing the present invention. A pair of cooling drums 1*a*, 1*b* have a cooling mechanism built-in, and the cooling drums each rotate in a direction opposite to that of the other. A pair of side gates 2*a*, 2*b* (though the opposite side is not illustrated in the figure) are applied to the respective ends of the cooling drums 1*a*, 1*b* by pushing, and a pair of the cooling drums 1*a*, 1*b* and a pair of the side gates 2*a*, 2*b* form a pouring basin 3. A molten steel 13 is supplied to the pouring basin 3 from a tundish 4. The molten steel 13 is cooled and solidified along the periphery of a pair of the cooling drums 1*a*, 1*b* to form solidified shells 14*a*, 14*b*. The solidified shells 14*a*, 14*b* are moved in synchronization with the cooling drums 1*a*, 1*b*, and united at a horizontal level where the cooling drums 1*a*, 1*b* approach each other most closely to give a thin cast strip 12.

A seal chamber 5 and a cooling apparatus 7 are connected to the lower end of a pair of the cooling drums 1*a*, 1*b*. A seal material such as refractory wool is provided in the gaps between the seal chamber 5, the cooling drums 1*a*,1*b* and the thin cast strip 12. An Ar gas is supplied to the seal chamber 5 where the oxygen concentration is kept at up to 5.0%. The thin cast strip 12 is transferred within the seal chamber 5 by pinch rolls 6*a*, 6*b*, a plurality of pairs of guide rolls 10*a*, 10*b* and a plurality of backup rolls 11, and is cooled to 1,200° C. in the Ar gas atmosphere within the seal chamber 5. As a result, $Fe_3O_4$ scale formation is inhibited.

The thin cast strip 12 is sent out of the seal chamber 5, and introduced into the cooling apparatus 7. In the cooling apparatus 7, many cooling nozzles 8 are arranged on the upper side and the lower side of the thin cast strip 12. The thin cast strip 12 is cooled through a temperature region to 800° C. at a rate of at least 10° C./sec with pneumatic water (atomized water) ejected from the cooling nozzles 8, whereby $Fe_3O_4$ scale formation is inhibited and the scale thickness is suppressed to up to 10 μm.

Figure 2:
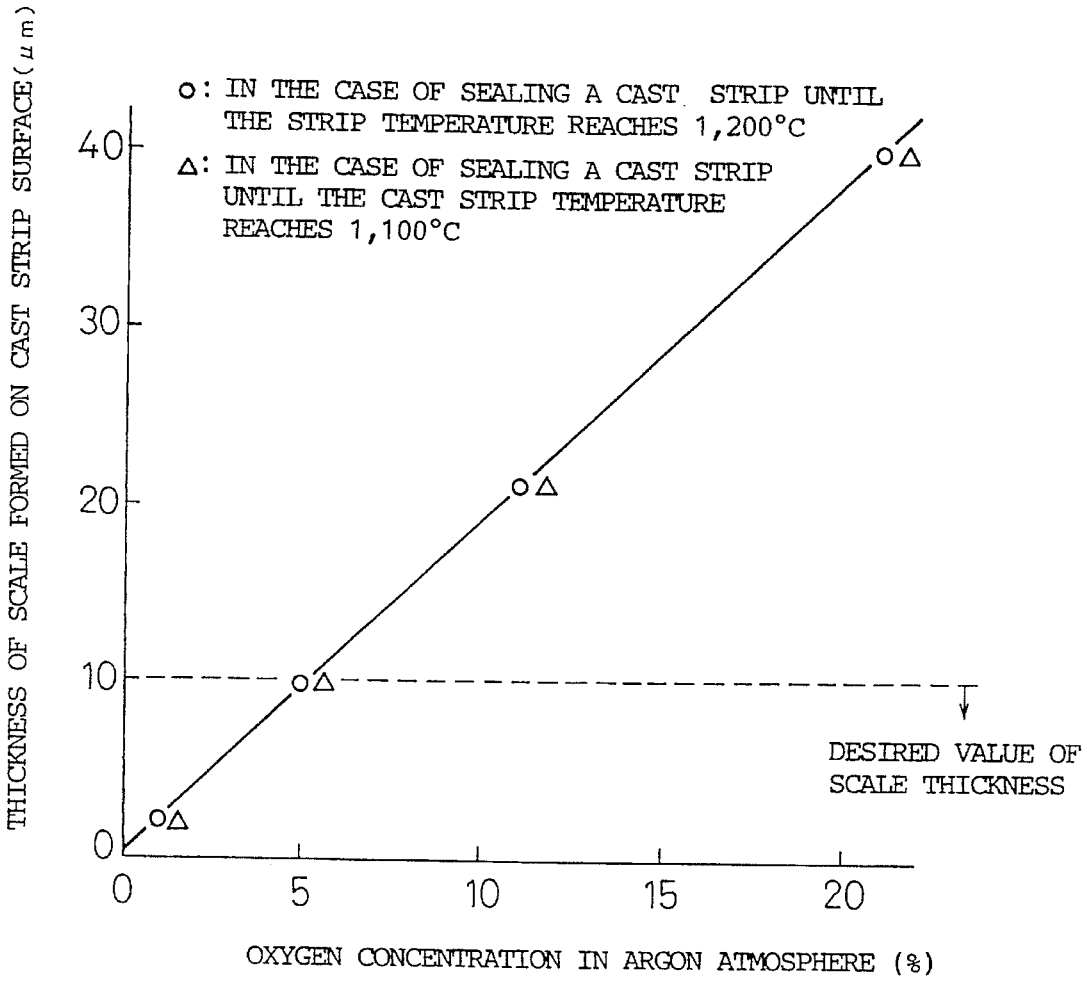
FIG. 2 is a graph showing the relationship between an oxygen gas concentration in an Ar gas atmosphere and a scale thickness in a first aspect to a third aspect of the present invention.

The 5 m to 10 m long seal chamber and the cooling apparatus were connected to the twin drum continuous casting machine, and the seal chamber was filled with an Ar gas having an oxygen concentration of 2 to 20%. A carbon steel containing from 0.03 to 0.5% of C was cast into a cast strip having a thickness of 3 mm, and the cast strip was held in an Ar gas atmosphere within the seal chamber for a while. The cast strip was then sent out of the seal chamber, and cooled with pneumatic water. FIG. 2 shows the relationship between a thickness of a scale formed on the cast strip and a concentration of oxygen in the Ar atmosphere.

In addition, when the strip was cast at a constant rate of 63 m/min, the strip slab sent out of the seal chamber 5 m long had a temperature of 1,200° C., and the one sent out of the seal chamber 10 m long had a temperature of 1,100° C.

It can be seen from FIG. 2 that the cast strip having a temperature of 1,200° C. or 1,100° C. has a scale as thick as exceeding 10 μm when the oxygen concentration in the Ar gas atmosphere exceeds 5%. When the scale thickness exceeds 10 μm, a rough surface appears on the cast strip at the time of pickling, and scab or scale defects are formed thereon at the time of cold rolling to impair the surface properties of the products. Accordingly, it is necessary to suppress the scale thickness to up to 10 μm. To satisfy the requirement, it is necessary that the cast strip be held in an Ar gas atmosphere having an oxygen concentration up to 5% through a strip temperature region to at least 1,200° C. (a strip temperature up to 1,200° C.).

In a cast strip temperature region lower than 1,200° C., the rate of scale formation is low. Holding the cast strip in an Ar gas atmosphere in this temperature region, therefore, is not advantageous because the seal chamber becomes excessively long and large compared with the scale inhibiting effects and the production efficiency becomes poor. When the cast strip is cooled at a rate of at least 10° C./sec through a strip temperature region to 800° C., an increase in the scale thickness can be efficiently suppressed.

Figure 3:
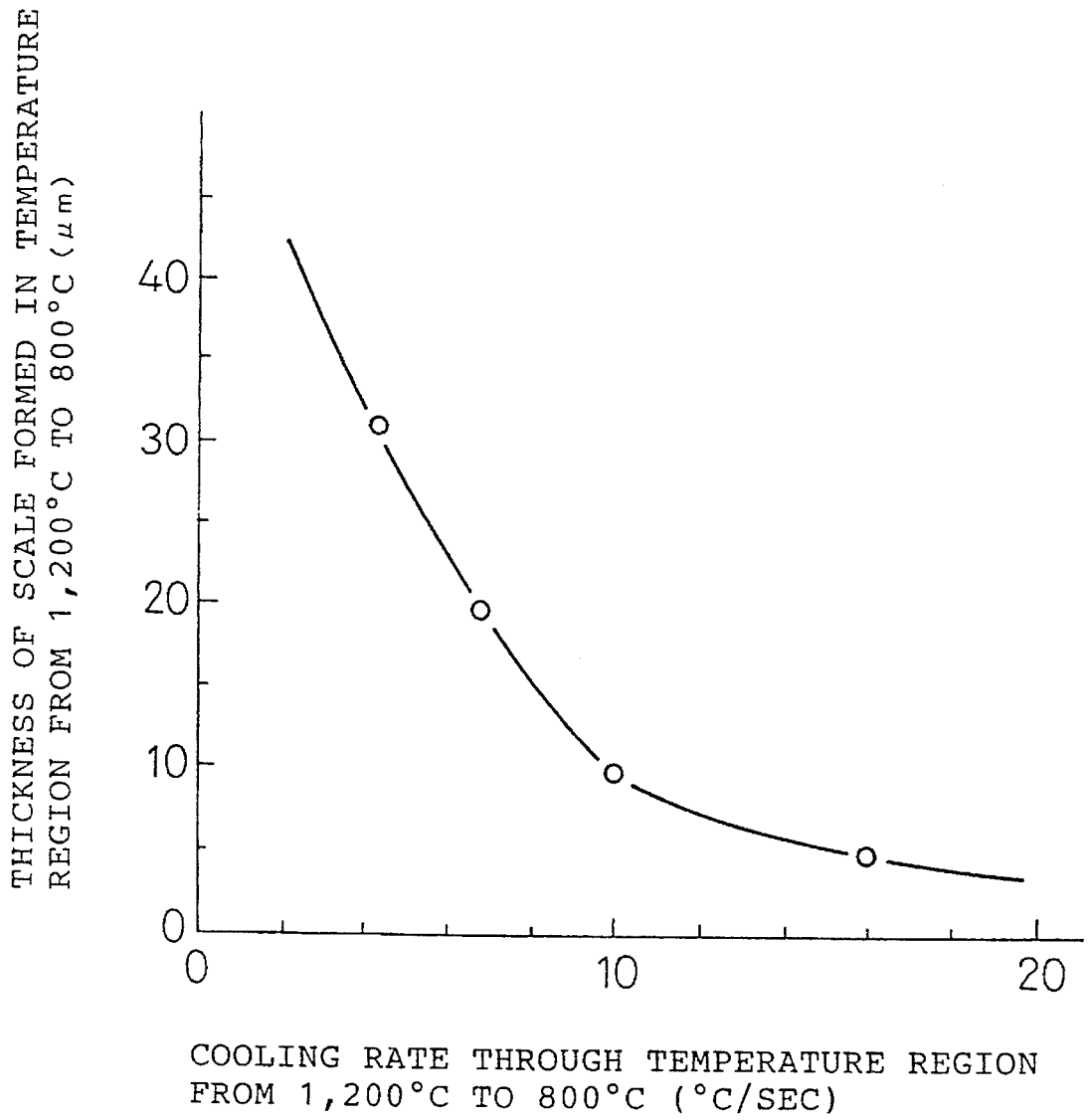
FIG. 3 is a graph showing the relationship between a cooling rate of a cast strip and a scale thickness in a first aspect to a third aspect of the present invention.

The cast strip was held in an Ar gas atmosphere having an oxygen concentration of 5% within the seal chamber, and the cast strip sent out of the chamber was cooled to 800° C. by the cooling apparatus. FIG. 3 shows the relationship between a cooling rate of the cast strip and a thickness of scale formed thereon. In addition, the cooling rate was changed by adjusting the amount of water.

It is seen from FIG. 3 that when the cast strip is cooled at a rate of at least 10° C./sec, the scale thickness can be suppressed to up to 10 μm.

In addition, when the cast strip sent out of the seal chamber had a temperature exceeding 1,200° C., the scale thickness could not be suppressed to up to 10 μm.

When the cast strip was coiled in a temperature region of at least 500° C. and up to 800° C. subsequently to the treatments shown in FIG. 2 and FIG. 3, the cast strip was held in a temperature region of 500 to 800° C. for at least 1 hour by its own heat. Consequently, $Fe_3O_4$ scale formation was inhibited, and the scale contained FeO as its main component.

Figure 4:
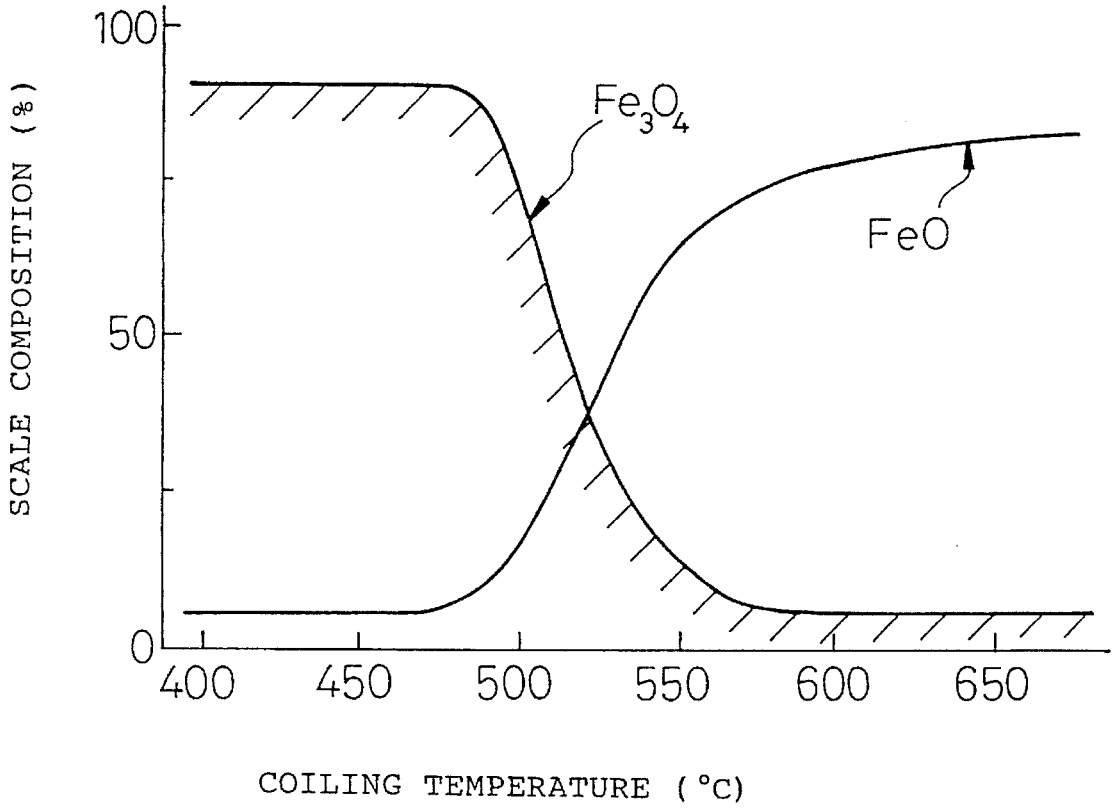
FIG. 4 is a graph showing showing the relationship between a coiling temperature of a cast strip and a scale composition in a first aspect to a third aspect of the present invention.

FIG. 4 shows the relationship between a coiling temperature at the time of coiling the cast strip in a coil form by the coiler subsequently to the treatments shown in FIG. 2 and FIG. 3 and a composition of the scale formed thereon subsequent to coiling. It is seen from FIG. 4 that when the cast strip has a temperature of at least 500° C. and up to 800° C. at the time of coiling it in a coil form by the coiler, there can be stably formed a scale which contains FeO as its main component and which can be easily peeled off. The cast strip thus obtained can, therefore, be easily descaled.

In a fourth aspect and a fifth aspect of the present invention, when the cast strip subsequent to continuous casting is held in a nitrogen atmosphere having an oxygen concentration up to 5.0% through a strip temperature region to at least 1,200° C., nitrogen is enriched on the strip surface, whereby the penetration of oxygen into the strip surface layer is suppressed. As a result, FeO scale formation is inhibited and the scale can be made to contain $Fe_3O_4$ as its main component.

Furthermore, when the cast strip is cooled through a temperature region to 750° C. at a rate of at least 10° C./sec subsequently to the holding procedure in a nitrogen atmosphere having an oxygen concentration up to 5.0%, there can be inhibited scale formation subsequent to the holding procedure in the atmosphere. The scale on the cast strip having been cooled under the conditions as mentioned above contains $Fe_3O_4$ as its main component, and has a thickness up to 10 μm. When the cast strip having such a scale is press worked or bent, the scale is not peeled off.

Still furthermore, when the cast strip subsequent to the cooling procedure has a temperature up to 600° C., FeO scale formation can further be inhibited by coiling the cast strip in a coil form by the coiler. Although the lower limit of the coiling temperature is better when the temperature is lower, a technically and economically advantageous temperature is selected.

Figure 5:
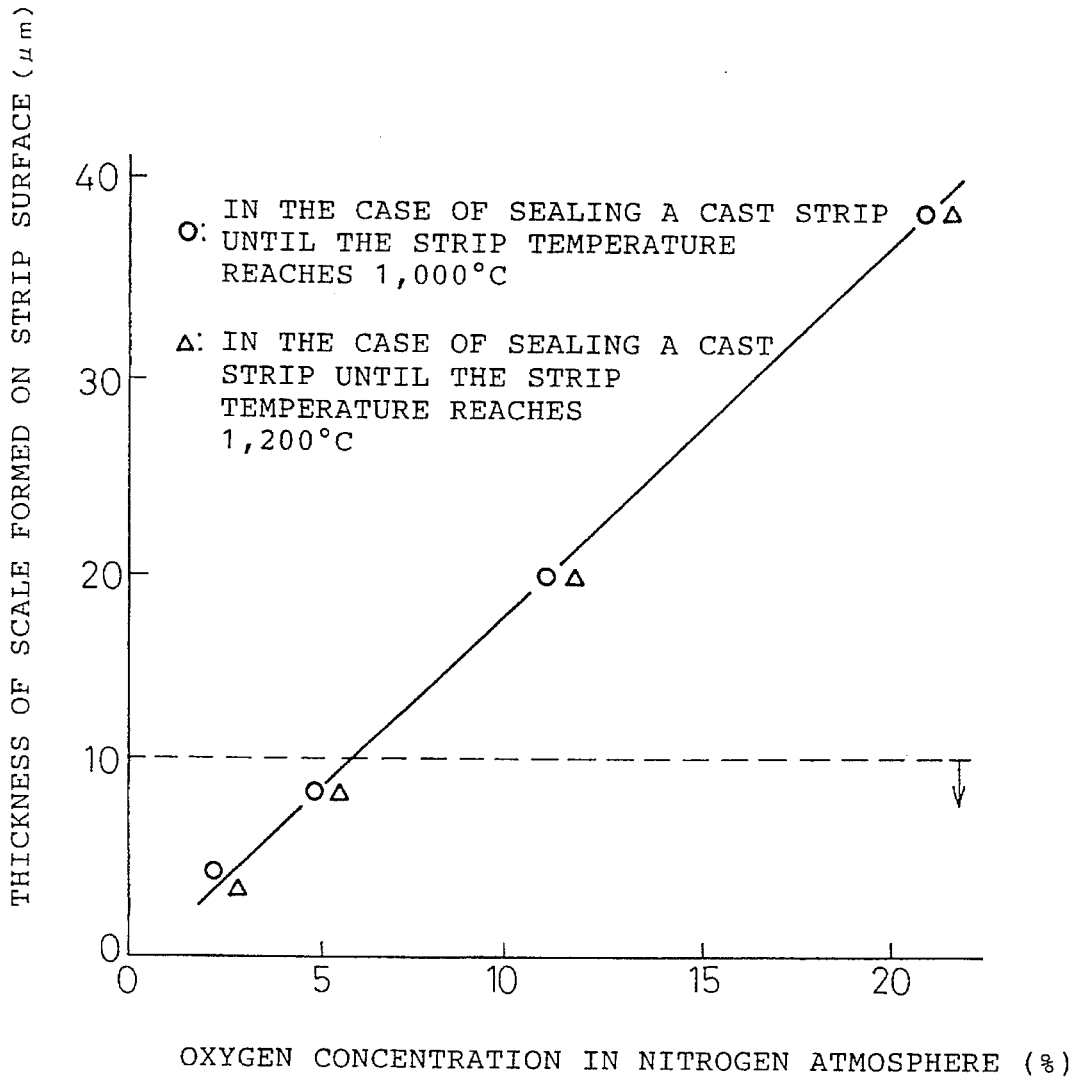
FIG. 5 is a graph showing the relationship between an oxygen gas concentration in a nitrogen atmosphere and a scale thickness in a fourth aspect and a fifth aspect of the present invention.

The seal chamber which could have a variable length of 5 m or 10 m was connected behind the twin drum continuous casting machine, and the cooling apparatus using pneumatic water was connected to the seal chamber. A nitrogen gas having an oxygen concentration of 2 to 20% was filled therein. The carbon cast strip 4.0 mm thick coming from the casting machine was held in the nitrogen atmosphere within the seal chamber, and the cast strip sent out of the seal chamber was cooled with pneumatic water. FIG. 5 shows the relationship between a thickness of a scale formed on the cast strip and an oxygen concentration in the nitrogen atmosphere.

In addition, when the steel was cast into a cast strip at a constant rate of 63 m/min, the cast strip sent out of the seal chamber 5 m long had a temperature of 1,200° C., and the one sent out of the seal chamber 10 m long had a temperature of 1,000° C.

It can be seen from FIG. 5 that the scale thickness becomes as thick as exceeding 10m when the cast strip has a temperature of 1,200° C. or 1,000° C. and when the nitrogen atmosphere has an oxygen gas concentration exceeding 5.0%. When the cast strip with a scale having a thickness exceeding 10 μm is press worked or bent, the scale is peeled off, and impairs the surface properties of the products. Accordingly, to prevent the scale from being peeled off, it is necessary that the cast strip be held in a nitrogen atmosphere having an oxygen concentration up to 5.0%, desirably 0% through a strip temperature region to at least 1,200° C. (up to 1,200° C.).

Figure 6:
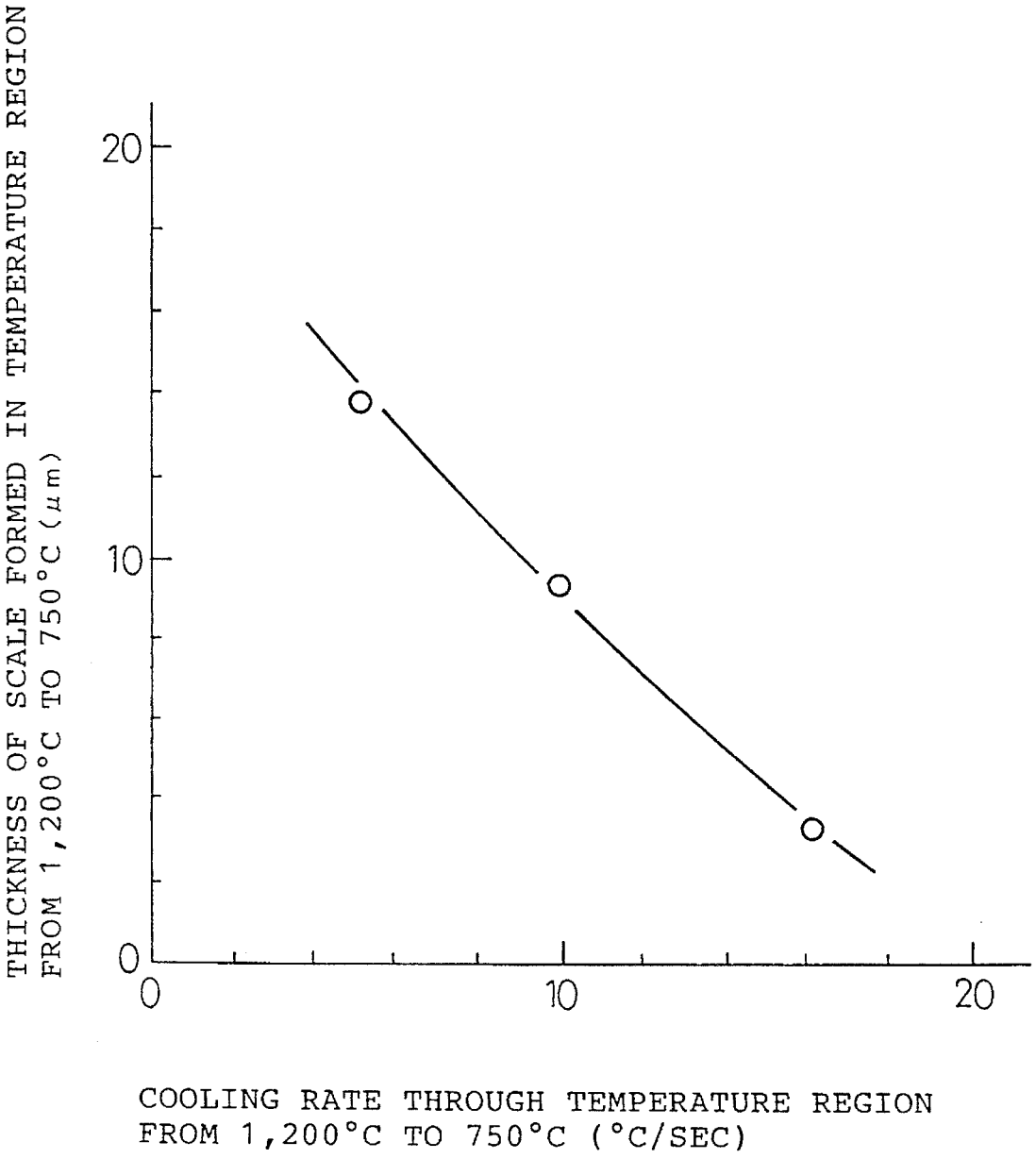
FIG. 6 is a graph showing the relationship between a cooling rate of a cast strip and a scale thickness in a fourth aspect and a fifth aspect of the present invention.

A nitrogen gas having an oxygen concentration of 5.0% was filled in the seal chamber, and the cast strip sent out of the seal chamber was cooled to 750° C. by the cooling apparatus. FIG. 6 shows the relationship between a cooling rate of the cast strip and a thickness of a scale formed thereon.

It is seen from FIG. 6 that when the cast strip sent out of the seal chamber is cooled at a rate of at least 10° C./sec, the scale thickness can be suppressed to up to 10 μm, Although the upper limit of the cooling rate is better when the rate is higher, a technically and economically preferable rate is selected.

In addition, when the cast strip sent out of the seal chamber had a temperature exceeding 1,200° C., the scale thickness could not be suppressed to up to 10 μm.

Figure 7:
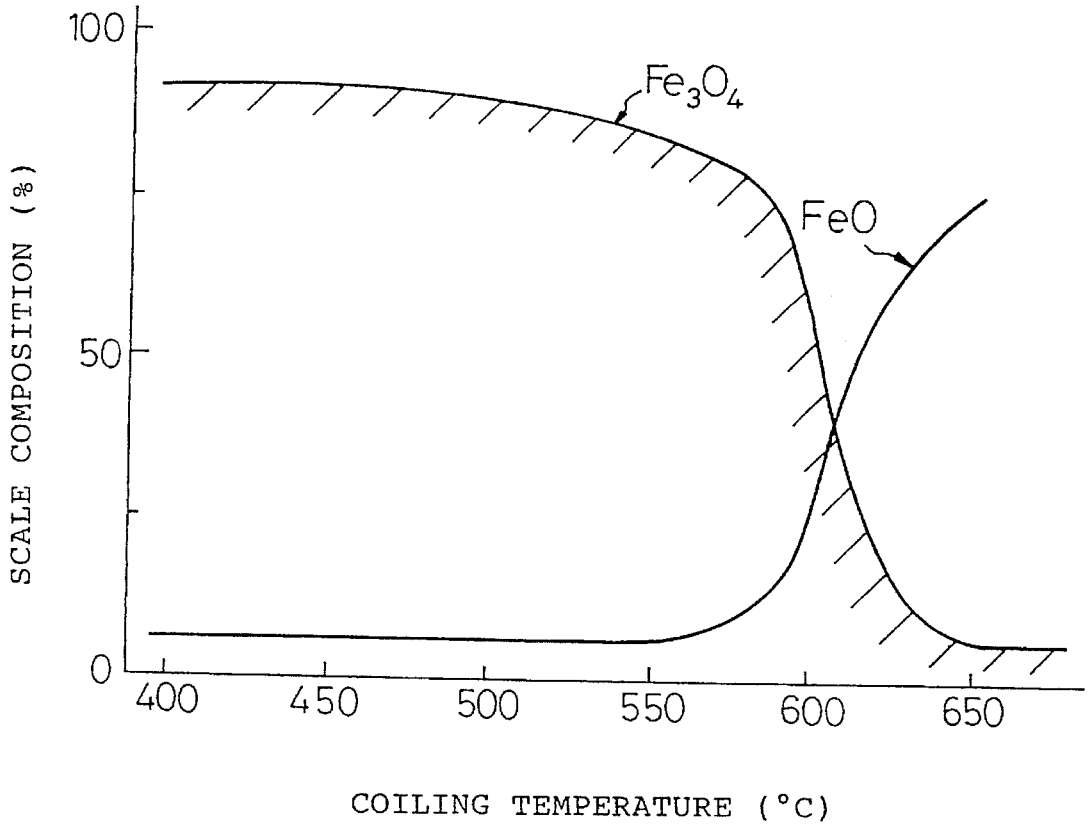
FIG. 7 is a graph showing the relationship between a coiling temperature of a cast strip and a scale composition in a fourth aspect and a fifth aspect of the present invention.

FIG. 7 shows the relationship between a temperature of the cast strip coiled in a coil form by the coiler (coiling temperature) subsequently to cooling at a rate of at least 10° C./sec as shown in FIG. 6 and a composition of a scale formed thereon after coiling. In the figure, when the temperature of the cast strip at the time of coiling in a coil form by the coiler is up to 600° C., preferably up to 550° C., the cast strip is held at a temperature up to 600° C., preferably up to 550° C. by its own heat. Consequently, FeO formation in the scale of the cast strip is inhibited, and the proportion of $Fe_3O_4$ in the scale is increased.

In a sixth aspect and a seventh aspect of the present invention, when the thin cast strip subsequent to continuous casting is held in an exhaust gas atmosphere having an oxygen concentration up to 5% and a dew point up to 40° C., scale formation on the cast strip is inhibited by $CO_2$, nitrogen and oxygen in the exhaust gas atmosphere.

Moreover, when the cast strip is cooled at a rate of at least 10° C./sec through a temperature region to 750° C. subsequently to the holding procedure in the exhaust gas atmosphere, scale formation is inhibited in the same manner as mentioned above, and a scale containing FeO as its main component and having a thickness up to 10 μm is formed. When the cast strip having the scale thus formed is press worked or bent, the scale is not peeled off.

When the cast strip having a temperature up to 600° C., desirably up to 500° C. is coiled in a coil form by the coiler subsequently to the cooling procedure, the scale formed on the cast strip can be made to contain $Fe_3O_4$ as its main component while the formation of FeO is inhibited. Although the lower limit of the coiling temperature is better when it is lower, a technically and economically advantageous temperature is selected.

Figure 8:
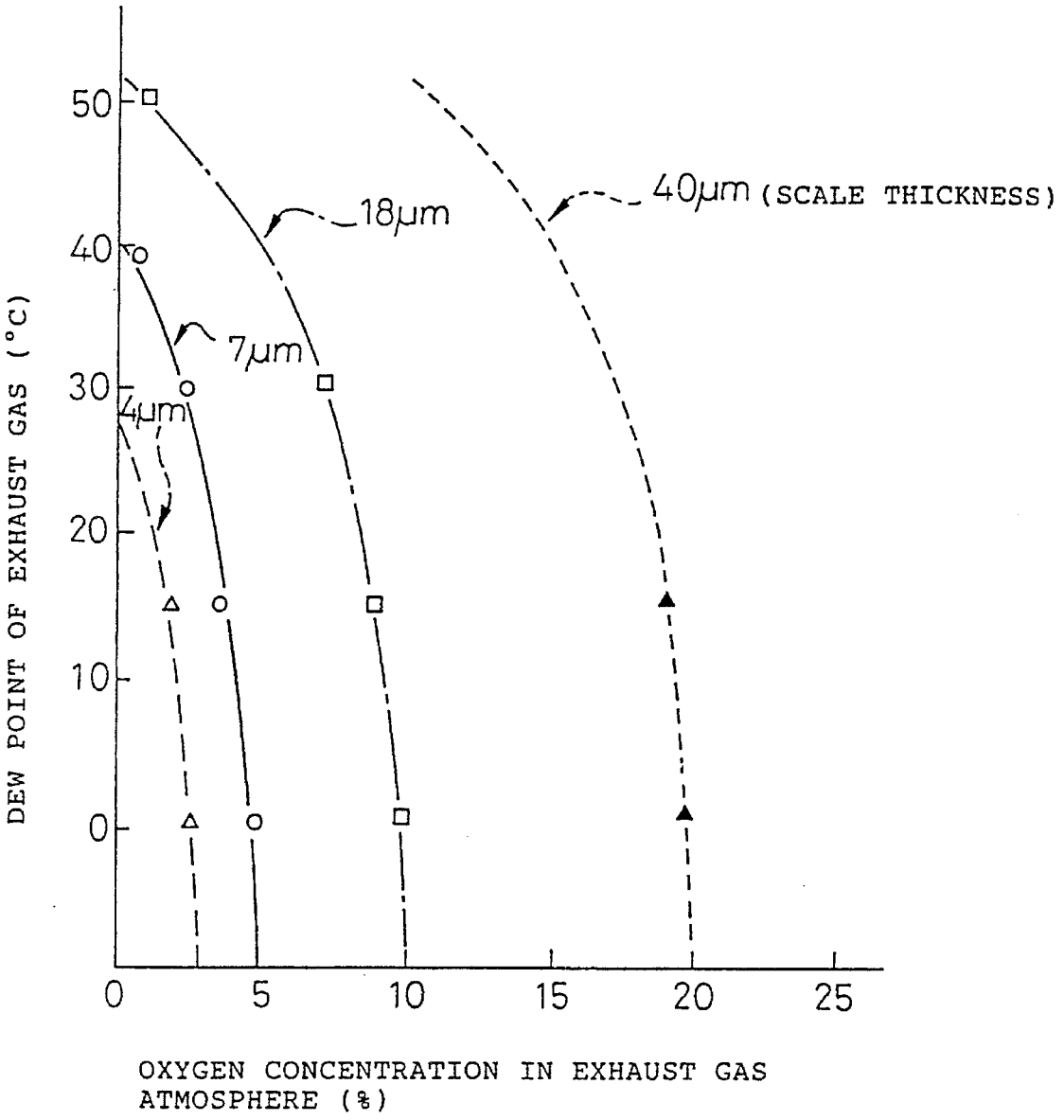
FIG. 8 is a graph showing the relationships between an oxygen concentration and a dew point of an exhaust gas atmosphere and a scale thickness in a sixth aspect and a seventh aspect of the present invention.

A seal chamber having a length of 5 m was connected to the lower end of the casting machine, and an exhaust gas having an oxygen concentration of 2 to 20% and a dew point of 0° to 50° C. was filled therein. A carbon steel containing from 0.005 to 0.5% of C was cast into a thin cast strip having a thickness of 3 mm. The cast strip was held in the exhaust gas atmosphere within the seal chamber, and then cooled with pneumatic water when the strip was sent out of the chamber. FIG. 8 shows the relationships between an oxygen concentration and a dew point of the exhaust gas atmosphere and a thickness of the scale formed on the cast strip.

In addition, when the steel was cast into the cast strip at a constant rate of 63 m/min, the cast strip had a temperature of 1,200° C. at the time of sending the cast strip out of the seal chamber 5 m long and a temperature of 1,100° C. at the time of sending the cast strip out of the seal chamber 10 m long.

It can be seen from FIG. 8 that when the cast strip having a temperature of 1,200° C. is sent out of the seal chamber filled with an exhaust gas atmosphere having an oxygen concentration exceeding 5% or a dew point exceeding 40° C., the scale becomes as thick as exceeding 10 μm. When the cast strip having a scale thickness exceeding 10 μm is press worked or bent, the scale is peeled off and impairs the surface properties of the products. Accordingly, the scale thickness is required to be suppressed to up to 10 μm. To satisfy the requirement, it is necessary that the cast strip be held in the exhaust gas atmosphere having an oxygen concentration up to 5%, desirably 0% through a strip temperature region to 1,200° C. (at least 1,200° C.).

When the cast strip has a temperature up to 1,200° C., the rate of scale formation is small. Holding the cast strip in the exhaust gas atmosphere in this temperature region is not advantageous because the seal chamber becomes excessively long and large compared with the effects of inhibiting scale formation and because the production efficiency becomes poor. When the cast strip is cooled at a rate of at least 10° C./sec at strip temperatures up to 1,200° C., concretely through a temperature region from 1,200° to 750° C. (namely, residence time up to 60 sec), scale formation can be efficiently inhibited.

Figure 9:
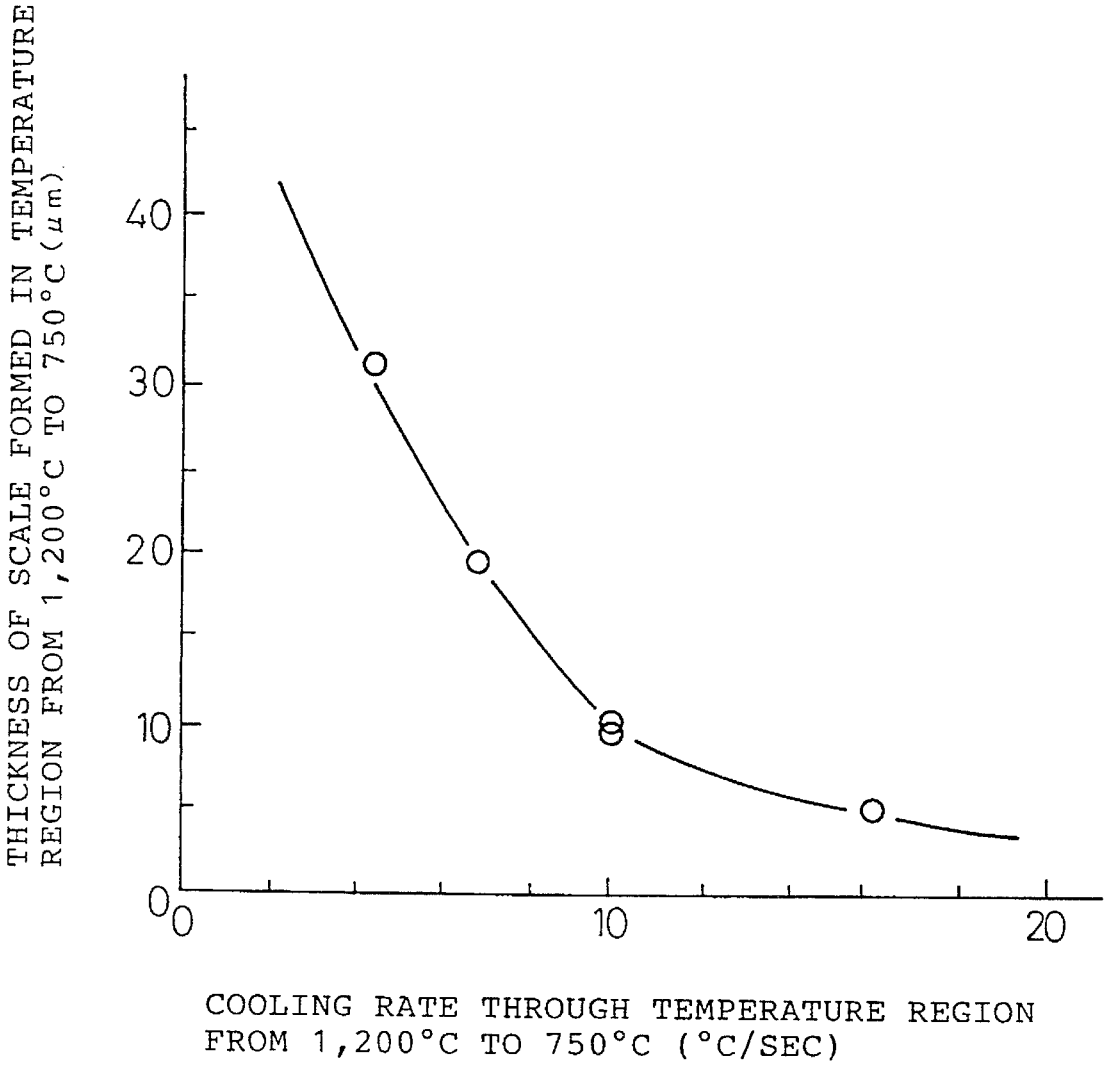
FIG. 9 is a graph showing the relationship between a cooling rate of a cast strip and a scale thickness in a sixth aspect and a seventh aspect of the present invention.

The seal chamber and the cooling apparatus were connected to the casting machine, and an exhaust gas having an oxygen concentration of 5% and a dew point 0° to 40° C. was filled in the seal chamber. The same carbon steel as mentioned above was cast into a thin cast strip having a thickness of 3 mm. The cast strip was held in the exhaust gas atmosphere within the seal chamber until the strip had a temperature of 1,200° C. The cast strip sent out of the seal chamber was then cooled to 750° C. by the cooling apparatus. FIG. 9 shows the relationship between a cooling rate of a cast strip during cooling the strip to 750° C. and a thickness of a scale formed thereon. In addition, the cooling rate was varied by adjusting the amount of water.

It can be seen from FIG. 9 that when the cast strip is cooled at a rate of at least 10° C./sec, the scale thickness can be suppressed to up to 10 μm . Although the upper limit of the cooling rate is better when it is higher, a technically and economically advantageous cooling rate is selected.

In addition, when the cast strip sent out of the seal chamber had a temperature exceeding 1,200° C., the scale thickness could not be suppressed to up to 10 μm.

When the thin cast strip is coiled at temperatures up to 600° C., preferably up to 500° C., subsequently to the treatments shown in FIG. 8 and FIG. 9, the cast strip is held at temperatures up to 600° C., preferably up to 500° C. for at least 1 hour with its own heat. The cast strip can thus be made to have a scale containing $Fe_3O_4$ as its main component while FeO formation is being inhibited.

Figure 10:
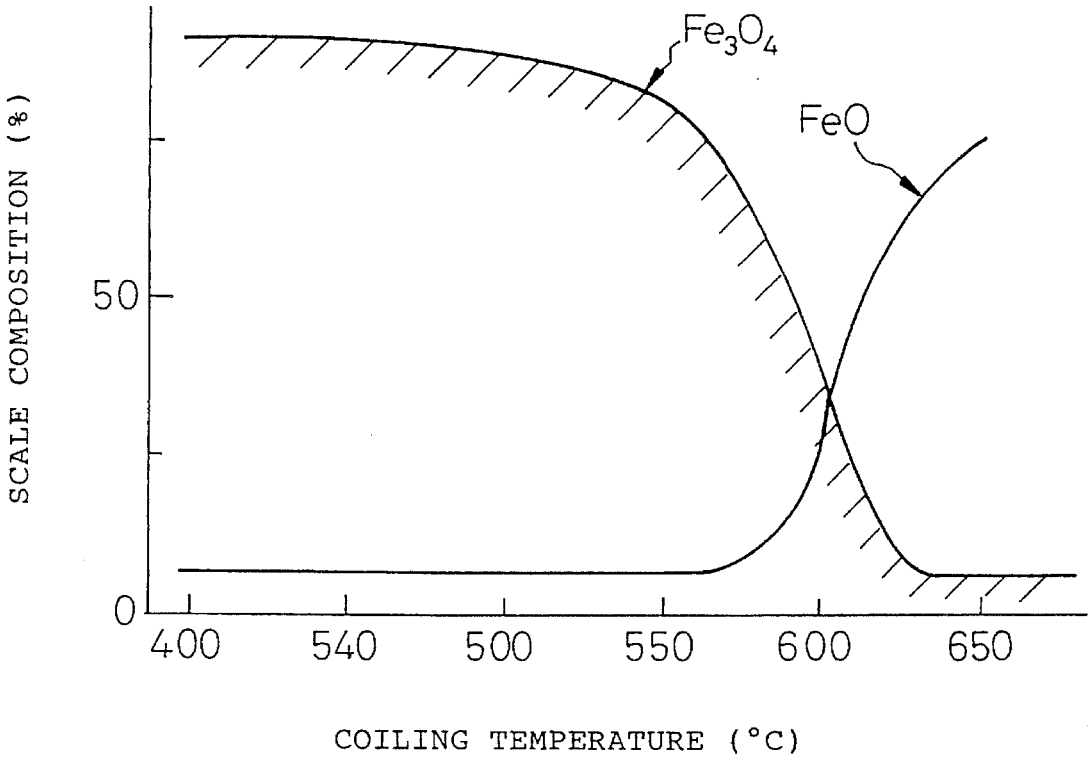
FIG. 10 is a graph showing the relationship between a coiling temperature of a cast strip and a scale composition in a sixth aspect and a seventh aspect of the present invention.

FIG. 10 shows the relationship between a coiling temperature and a composition of a scale formed on the thin cast strip which has been coiled in a coil form by the coiler subsequently to the treatments mentioned above. In the figure, when the thin cast strip to be coiled in a coil form by the coiler has a temperature up to 600° C., a scale containing $FE_3O_4$ as its main component and difficult to peel off can be stably formed. The scale can thus be prevented from being peeled off during working the cast strip.

In an eighth aspect to a tenth aspect of the present invention, when the cast strip subsequent to continuous casting is held in a nitrogen atmosphere having an oxygen concentration of up to 7.0% through a strip temperature region up to 1,200° C., nitrogen is enriched on the cast strip surface. Consequently, oxygen penetration into the strip surface layer is prevented, and scale formation is inhibited. When the cast strip contains at least 0.1% of Cr or Cu, dense CrN or CuN is formed thereon, and the penetration of oxygen into the strip surface layer is further prevented.

Subsequently to the holding procedure in the nitrogen atmosphere, the cast strip is cooled at a rate of at lease 10° C./sec through a temperature region to 750° C., whereby scale formation is inhibited after the holding procedure therein. Since CrN and CuN mentioned above are uniformly dispersed when the cast strip is quenched, oxygen penetration into the strip surface layer is prevented. As a result, scale formation is further inhibited, and the scale thickness can be suppressed to up to 10 μm. When the cast strip on which the scale thus formed is present is press worked or bent, the scale is not peeled off.

Furthermore, when the cast strip subsequent to cooling having a temperature up to 600° C. is coiled in a coil form by the coiler, FeO formation at the interface between the strip surface and the scale is inhibited, and the proportion of $Fe_3O_4$ in the scale can be increased. Even when the cast strip having the scale thus formed is press worked or bent, the scale is not peeled off.

Figure 11:
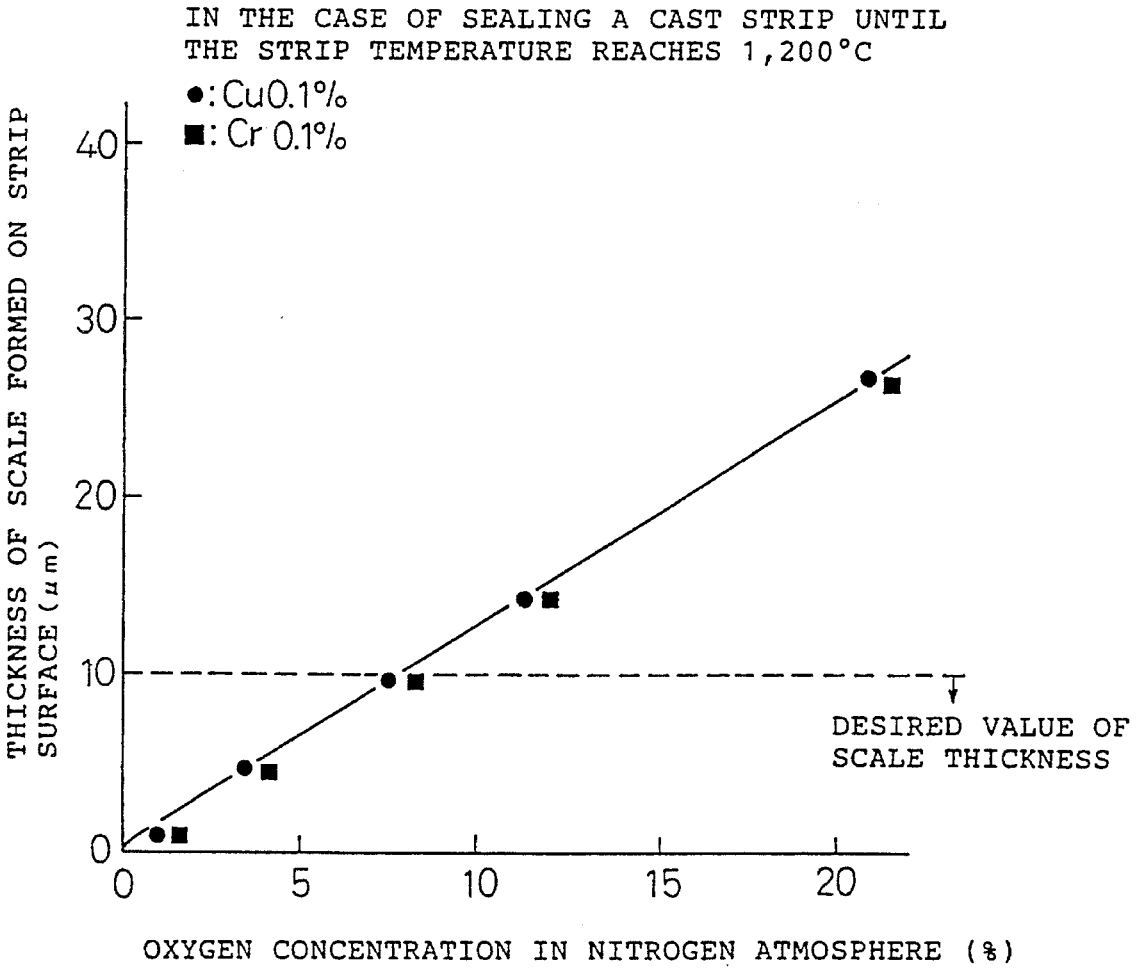
FIG. 11 is a graph showing the relationship between an oxygen gas concentration in a nitrogen atmosphere and a scale thickness in an eighth aspect to a tenth aspect of the present invention.

The seal chamber having a length of 5 m or 10 m and the cooling apparatus using pneumatic water were connected to the twin drum casting machine, and a nitrogen gas having an oxygen concentration of 2 to 20% was filled in the seal chamber. A carbon steel containing 0.01 to 0.5% of C, 0.05 to 1.0% of Cr and 0.03 to 1.0% of Cu was cast into a cast strip having a thickness of 4.0 mm. The resulting cast strip was held in the nitrogen atmosphere within the seal chamber, and cooled with pneumatic water when the cast strip was sent out of the seal chamber. FIG. 11 shows the relationship between a thickness of a scale formed on the cast strip and an oxygen concentration in the nitrogen atmosphere.

In addition, when the steel was cast into a cast strip at a constant rate of 63 m/min, the cast strip had a temperature of 1,200° C. at the time of sending the cast strip out of the seal chamber 5 m long, and a temperature of 1,100° C. at the time of sending the cast strip out of the seal chamber 10 m long.

It can be seen from FIG. 11 that when the cast strip sent out of the seal chamber filled with a nitrogen atmosphere which has an oxygen concentration exceeding 7% has a temperature of 1,100° C. or 1,200° C., the scale thus formed has a thickness exceeding 10 μm (see FIG. 5). Moreover, the cast strip containing less than 0.1% of Cu or Cr comes to have a scale as thick as exceeding 10 μm even when the nitrogen atmosphere has an oxygen concentration up to 7%. When the cast strip having a scale thickness exceeding 10 μm is press worked or bent, the scale is peeled off to impair the surface properties of the products. Accordingly, in order to suppress the scale thickness to up to 10 μm, it is necessary that the cast strip contain at least 0.1% of Cu or Cr, and that the cast strip be held in a nitrogen atmosphere having an oxygen concentration up to 7% through a strip temperature region to at least 1,200° C. (up to 1,200° C.).

When the cast strip has a temperature up to 1,200° C., the rate of scale formation is small. Accordingly, holding the cast strip in the nitrogen atmosphere in the temperature region is not advantageous because the seal chamber becomes excessively long and large compared with the scale inhibition effects and the productivity becomes poor. When the cast strip is cooled at a rate of at lease 10° C./sec at strip temperatures up to 1,200° C., concretely through a strip temperature region to 750° C., the scale formation can be efficiently inhibited.

Figure 12:
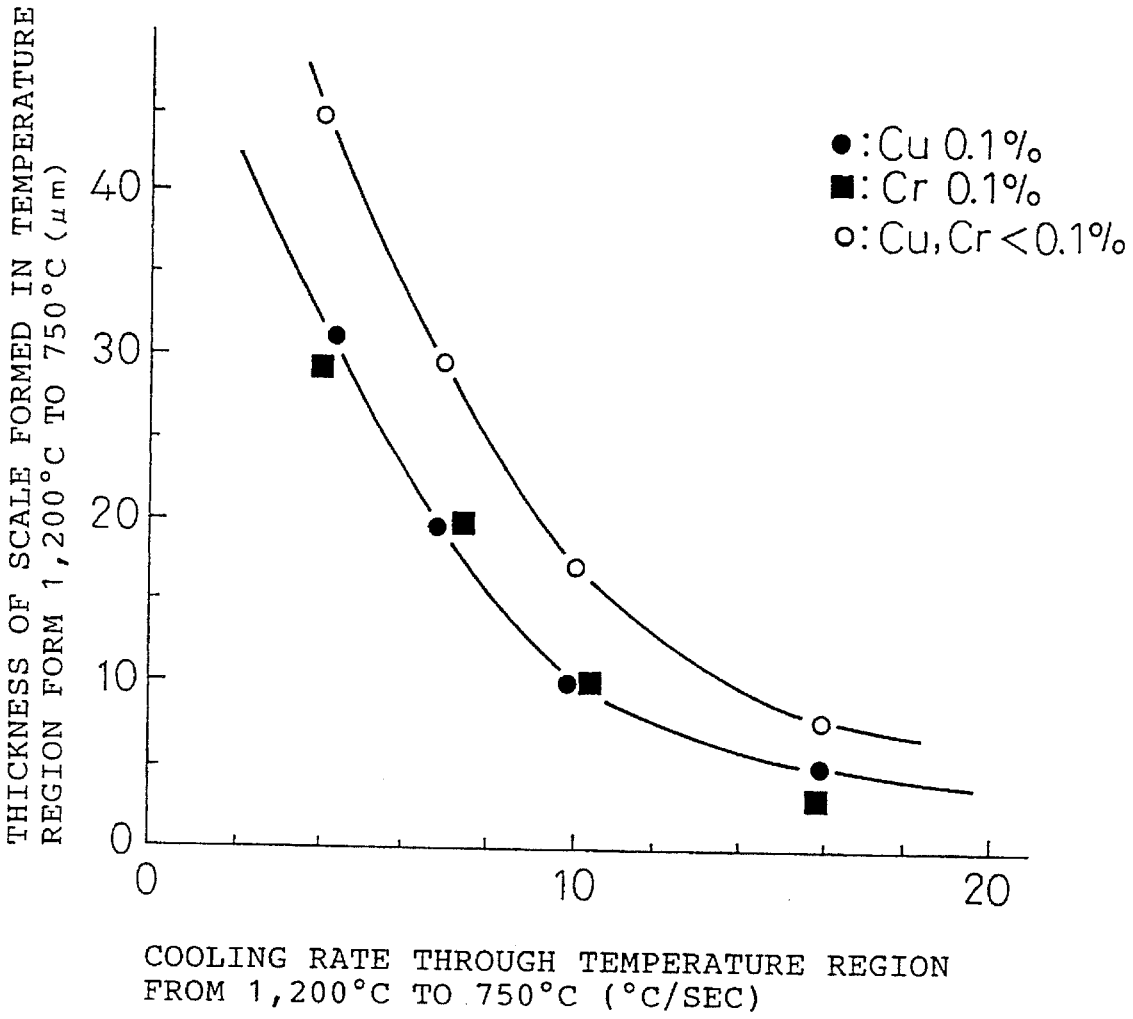
FIG. 12 is a graph showing the relationship between a cooling rate and a scale thickness of a cast strip in an eighth aspect to a tenth aspect of the present invention.

A nitrogen gas having an oxygen concentration of 7% was filled in the seal chamber. The same carbon steel as in FIG. 4 was held in the nitrogen atmosphere within the seal chamber, sent out of the seal chamber, and cooled through a temperature region to 750° C. by the cooling apparatus. FIG. 12 shows the relationship between a cooling rate and a thickness of scale formed on the cast strip. In addition, the cooling rate was controlled by adjusting the amount of water.

It is seen from FIG. 12 that when the cast strip is cooled at a rate of at least 10° C. /sec, the scale thickness can be suppressed to up. to 10 μm regardless of the concentration of Cu and Cr therein.

In addition, when the temperature of the cast strip sent out of the seal chamber exceeds 1,200° C., the scale thickness cannot be suppressed to up to 10 μm.

When the cast strip was coiled at temperatures up to 600° C. subsequently to the treatments as shown in FIG. 11 and FIG. 12, the cast strip was held at temperatures up to 600° C. for at least an hour by its own heat. As a result, FeO scale formation was inhibited, and the proportion of $Fe_3O_4$ in the scale could be increased.

Figure 13:
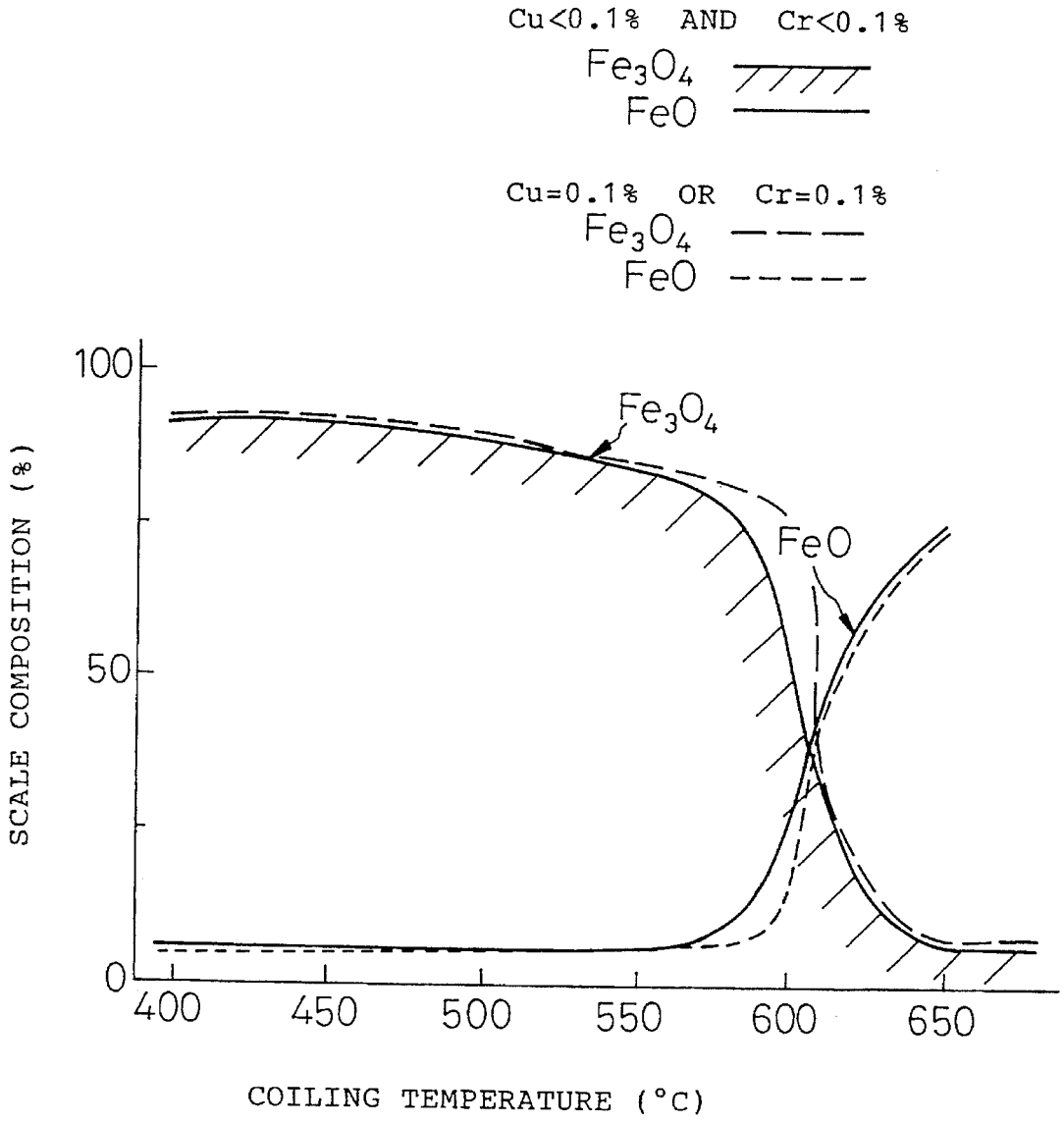
FIG. 13 is a graph showing the relationship between a coiling temperature and a scale composition of a cast strip in an eighth aspect to a tenth aspect of the present invention.

FIG. 13 shows the relationship between a coiling temperature at the time of coiling the cast strip in a coil form by the coiler and a composition of a scale formed thereon. It is seen from the figure that when the strip temperature is up to 600° C., preferably up to 550° C. at the time of coiling the strip in a coil form by the coiler, a scale containing $Fe_3O_4$ as its main component and difficult to peel off can be stably formed. As a result, the scale can be prevented from being peeled off during working the cast strip. Moreover, when the content of Cr or Cu in the cast strip is at least 0.1%, CrN or CuN is enriched and precipitated on the strip surface, and the proportion of $Fe_3O_4$ in the scale can thus be made high.

The present invention will be explained in detail by making reference to examples.

EXAMPLES

Example 1

The first aspect to the third aspect of the present invention will be illustrated.

In this example, an Ar gas was supplied to a seal chamber 5 of a twin drum continuous casting machine in FIG. 1 to maintain the oxygen gas concentration at up to 5.0% therein. A thin cast strip 12 was transferred through the seal chamber 5 and cooled to 1,200° C. in the Ar gas atmosphere therein, whereby $Fe_3O_4$ scale formation was inhibited.

The thin cast strip 12 was then sent out of the seal chamber 5 and introduced into a cooling apparatus 7. Many cooling nozzles 8 were arranged on the upper side and the lower side of the thin cast strip 12 in the cooling apparatus 7. The thin cast strip 12 was cooled with pneumatic water ejected from the cooling nozzles 8 in a temperature region to 800° C. at a cooling rate of at least 10° C./sec. As a result, $Fe_3O_4$scale formation was suppressed to a thickness up to 10μm.

The thin cast strip 12 sent out of the cooling apparatus 7 was coiled in a coil form by a coiler 9 at temperatures of at least 500° C. and up to 800° C., whereby the strip was held at temperatures from 500° to 800° C. for at least 1 hour. The formation of $Fe_3O_4$ at the interface between the strip surface and the scale was suppressed by the holding procedure, and a scale containing FeO as its main component was formed.

A carbon steel was cast into a thin cast strip having a thickness of 2.0 to 6.0 mm at a rate of 80 m/sec using the twin drum continuous casting machine as shown in FIG. 1. The cast strip was coiled by the coiler, cooled to room temperature, and then bent at angles of 90° and 120°.

Table 1 shows the chemical compositions of the carbon steels having been cast. Table 2 shows the atmospheres within the seal chamber, the cooling rates of the cast strips, the temperatures of the cast strips at the time of sending the strips out of the seal chamber and the cast strip temperatures at the time of coiling. Table 3 shows the thicknesses and compositions of the scales formed on the cast strips, the ability of being descaled of the cast strips at the time of pickling, and the surface properties thereof after cold rolling. In addition, the compositions of scales in Table 3 shows FeO (%) alone, and the balances (%) are $Fe_3O_4$ and partly $Fe_2O_3$.

TABLE 1

| NO. | C | Si | Mn | S | P | Al | (wt. %) N |
|---|---|---|---|---|---|---|---|
| 1 | 0.006 | 0.02 | 0.03 | 0.015 | 0.018 | 0.018 | 0.0043 |
| 2 | 0.019 | 0.04 | 0.04 | 0.011 | 0.015 | 0.025 | 0.0031 |
| 3 | 0.026 | 0.06 | 0.06 | 0.017 | 0.012 | 0.032 | 0.0051 |
| 4 | 0.025 | 0.08 | 0.07 | 0.013 | 0.013 | 0.023 | 0.0031 |
| 5 | 0.121 | 0.21 | 0.21 | 0.011 | 0.015 | 0.035 | 0.0041 |
| 6 | 0.042 | 0.12 | 0.13 | 0.018 | 0.010 | 0.020 | 0.0041 |
| 7 | 0.056 | 0.18 | 0.15 | 0.012 | 0.012 | 0.022 | 0.0061 |
| 8 | 0.082 | 0.12 | 0.17 | 0.019 | 0.016 | 0.036 | 0.0031 |
| 9 | 0.033 | 0.11 | 0.11 | 0.016 | 0.016 | 0.036 | 0.0021 |
| 10 | 0.152 | 0.52 | 1.33 | 0.023 | 0.013 | 0.023 | 0.0031 |

TABLE 2

| | Within seal chamber | | Cooling rate | Cast strip temp. |
|---|---|---|---|---|
| | Atmosphere | Strip temp. (°C.) | of cast strip (°C./sec) | during coiling (°C.) |
| Ex. No. 1 | Ar ($O_2$; 5%) | 1200 | 10 | *900 |
| Ex. No. 2 | Ar ($O_2$; 5%) | 1200 | 13 | 550 |
| Ex. No. 3 | Ar ($O_2$; 5%) | 1200 | 10 | 600 |
| Ex. No. 4 | Ar ($O_2$; 3%) | 1000 | 15 | 800 |
| Ex. No. 5 | Ar ($O_2$; 1%) | 1200 | 15 | 700 |
| Comp. Ex. No. 6 | #Ar ($O_2$; 7%) | 1200 | 10 | 550 |
| Comp. Ex. No. 7 | Ar ($O_2$; 5%) | #1300 | 13 | 600 |
| Comp. Ex. No. 8 | Ar ($O_2$; 5%) | 1200 | #7 | 550 |
| Comp. Ex. No. 9 | #Ar ($O_2$; 7%) | #1250 | #7 | *900 |
| Comp. Ex. No. 10 | #Ar ($O_2$; 10%) | #1300 | #7 | *450 |

Note:
#The data deviated from the requirements of the present invention.
*The data deviated from the preferred conditions of the present invention.

TABLE 3

| | Cast strip scale | | | Surface properties of |
|---|---|---|---|---|
| | Thickness (μm) | FeO (%) | Residual scale | cold rolled steel sheet |
| Ex. No. 1 | 9 | 90 | No scale | Good surface |
| Ex. No. 2 | 8 | 50 | No scale | Good surface |
| Ex. No. 3 | 8 | 85 | No scale | Good surface |
| Ex. No. 4 | 7 | 85 | No scale | Good surface |
| Ex. No. 5 | 6 | 95 | No scale | Good surface |
| Comp. Ex. No. 6 | 15 | 50 | In small amt. | Scab in medium amt. |
| Comp. Ex. No. 7 | 17 | 70 | In small amt. | Scab in medium amt. |
| Comp. Ex. No. 8 | 18 | 70 | In small amt. | Scab in medium amt. |
| Comp. Ex. No. 9 | 23 | 90 | In large amt. | Scab in large amt. |
| Comp. Ex. No. 10 | 27 | 10 | In large amt. | Scab in large amt. |

Since the coiling temperature of the cast strip deviated from the preferred conditions in Example No. 1, the scale thus formed was somewhat thick. Since all the experimental conditions were appropriate in Example No. 2 to Example No. 5, there was no residual scale, and the cold rolled steel sheets thus obtained had good surface properties. In contrast to the above results, since one of the requirements of the present invention was not satisfied in any of Comparative Example No. 6 to No. 8, a small amount of scale remained, and scab was formed on the cold rolled steel sheet in a medium amount. Since all the requirements of the invention were not satisfied at all in Comparative Example No. 9 to No. 10, a large amount of scale remained, and scab was formed on the cold rolled steel sheets in a large amount.

In addition, the cooling rate is restricted to at least 10° C./sec at temperatures to 800° C. in the present invention, a preferred cooling rate is from 10° C./sec to 15° C./sec as in the example.

Furthermore, although the chemical composition of the cast strip scale are not specifically restricted, the content of FeO therein is preferably from 70 to 95% as shown in the example of the present invention.

Example 2

The fourth aspect and the fifth aspect of the present invention will be illustrated by making reference to Example.

In this example, a nitrogen gas was supplied to the seal chamber 5 to maintain an oxygen gas concentration at up to 5.0% therein using the same machine as in Example 1. A thin cast strip 12 was transferred through the seal chamber 5 and cooled to up to 1,200° C. in a nitrogen atmosphere therein to form a tight, thin scale containing $Fe_3O_4$ as its main component on the surface. The thin cast strip 12 was then sent out of the seal chamber 5 and introduced into the cooling apparatus 7. Many cooling nozzles 8 were arranged on the upper side and the lower side of the thin cast strip 12 in the cooling apparatus 7. The thin cast strip 12 was cooled with pneumatic water ejected from the cooling nozzles 8 through a temperature region to 750° C. at a cooling rate of at least 10° C./sec, whereby scale formation was inhibited after the holding procedure in the nitrogen atmosphere and a FeO scale having a thickness up to 10 μm was stably formed.

The thin cast strip 12 sent out of the cooling apparatus 7 was coiled in a coil form by the coiler 9 at temperatures up to 600° C., and held at temperatures up to 600° C. for at least 1 hour. FeO scale formation was inhibited by the holding procedure, and the proportion of $Fe_3O_4$ in the scale was increased.

A carbon steel was cast into a thin cast strip having a thickness of 2.0 to 6.0 mm at a rate of 63 m/sec using the continuous casting machine as shown in FIG. 1. The cast strip was coiled by the coiler, and then the cast strip was bent at angles of 90° and 120°.

Table 4 shows the chemical compositions of the carbon steels having been cast. Table 5 shows the atmospheres within the seal chamber, the temperatures of the cast strips at the time of sending them out of the seal chamber, the cooling rates of the cast strips, and the cast strip temperatures at the time of coiling. Table 6 shows the thicknesses and compositions of the scales formed on the cast strips, and the peeled states of the scale after bending the cast strips. In addition, the compositions of scale in Table 6 shows $Fe_3O_4$ (%) alone, and the balances (%) are FeO mainly and $Fe_2O_3$.

TABLE 4

| No. | C | Si | Mn | S | P | Al | (wt. %) N |
|---|---|---|---|---|---|---|---|
| 11 | 0.041 | 0.018 | 0.032 | 0.015 | 0.018 | 0.025 | 0.0032 |
| 12 | 0.056 | 0.021 | 0.029 | 0.017 | 0.012 | 0.043 | 0.0034 |
| 13 | 0.045 | 0.031 | 0.030 | 0.013 | 0.013 | 0.036 | 0.0045 |
| 14 | 0.50 | 0.21 | 0.71 | 0.011 | 0.015 | 0.015 | 0.0052 |
| 15 | 0.042 | 0.034 | 0.031 | 0.018 | 0.010 | 0.037 | 0.0044 |
| 16 | 0.037 | 0.026 | 0.037 | 0.012 | 0.012 | 0.034 | 0.0039 |
| 17 | 0.032 | 0.027 | 0.035 | 0.019 | 0.016 | 0.032 | 0.0035 |
| 18 | 0.033 | 0.023 | 0.033 | 0.016 | 0.016 | 0.031 | 0.0033 |
| 19 | 0.15 | 0.05 | 1.33 | 0.023 | 0.013 | 0.010 | 0.0075 |

In this example, an exhaust gas was supplied to the seal chamber 5 to maintain an oxygen gas concentration at 0% therein using the same machine as in Example 1. A thin cast strip 12 was transferred through the seal chamber 5 by pinch rolls 6*a*, 6*b* and cooled to a temperature up to 1,200° C. in an exhaust gas atmosphere therein to form a tight, thin scale containing $Fe_3O_4$ as its main component on the surface.

The thin cast strip 12 was then sent out of the seal chamber 5 and introduced into the cooling apparatus 7. Many cooling nozzles 8 were arranged on the upper side and the lower side of the thin cast strip 12. The thin cast strip 12 was cooled with pneumatic water ejected from the cooling nozzles 8 through a temperature region to 750° C. at a rate of at least 10° C./sec, whereby scale formation was inhibited.

The thin cast strip 12 sent out of the cooling apparatus 7 was coiled in a coil form by the coiler 9 at temperatures up to 600° C., and held at temperatures up to 600° C. for at least 1 hour. The formation of FeO scale at the interface between the cast strip surface and the scale was inhibited by the holding procedure, and the scale can be made to contain $Fe_3O_4$ as its main component.

TABLE 5

| | Within seal chamber | | Cooling apparatus | | Strip temp. |
|---|---|---|---|---|---|
| | Atmosphere | Strip temp. (°C.) | Cooling rate (°C./sec) | Strip temp. (°C.) | during coiling (°C.) |
| Ex. No. 11 | $N_2$ ($O_2$; 5%) | 1200 | 10 | 1200–800 | 600 |
| Ex. No. 12 | $N_2$ ($O_2$; 5%) | 1150 | 15 | 1150–800 | 550 |
| Ex. No. 13 | $N_2$ ($O_2$; 3%) | 1100 | 20 | 1100–750 | 550 |
| Ex. No. 14 | $N_2$ ($O_2$; 1%) | 1050 | 25 | 1050–700 | 500 |
| Comp. Ex. No. 15 | #Ar ($O_2$; 5%) | 1200 | 10 | 1200–800 | 600 |
| Comp. Ex. No. 16 | #$N_2$ ($O_2$; 7%) | 1200 | 10 | 1200–800 | 600 |
| Comp. Ex. No. 17 | $N_2$ ($O_2$; 5%) | #1250 | 10 | 1250–800 | 600 |
| Comp. Ex. No. 18 | $N_2$ ($O_2$; 5%) | 1150 | #5 | 1200–800 | 600 |
| Comp. Ex. No. 19 | $N_2$ ($O_2$; 5%) | 1200 | 10 | #1200–850 | *650 |

Note:
#The data deviated from the requirements of the present invention.
*The data deviated from the preferred conditions of the present invention.

TABLE 6

| | Cast strip scale | | Peeled state of scale | |
|---|---|---|---|---|
| | Thickness (μm) | $Fe_3O_4$ (%) | Bending at 90° | Bending at 120° |
| Ex. No. 11 | 10 | 50 | No peeling | No peeling |
| Ex. No. 12 | 9 | 80 | No peeling | No peeling |
| Ex. No. 13 | 9 | 85 | No peeling | No peeling |
| Ex. No. 14 | 8 | 90 | No peeling | No peeling |
| Comp. Ex. No. 15 | 17 | 50 | Slightly peeled | Almost peeled |
| Comp. Ex. No. 16 | 21 | 45 | Almost peeled | Almost peeled |
| Comp. Ex. No. 17 | 19 | 45 | Slightly peeled | Almost peeled |
| Comp. Ex. No. 18 | 18 | 45 | Slightly peeled | Almost peeled |
| Comp. Ex. No. 19 | 23 | 5 | Almost peeled | Almost peeled |

In Example No. 11 to No. 14 shown in Table 6, the scale was not peeled off when the cast strip samples were bent at angles of 90° and 120°. In contrast to the results mentioned above, in Comparative Example No. 15 to No. 19, the scale was slightly peeled off in some of the cast strip samples when the samples were bent at an angle of 90°, and the scale was almost peeled off in all of the samples when the strip samples were bent at an angle of 120°.

Example 3

The sixth aspect and the seventh aspect of the present invention will be illustrated by making reference to the Example.

A carbon steel was cast into a thin cast strip having a thickness of 2.0 to 4.0 mm at a rate of 80 m/sec using the continuous casting machine as shown in FIG. 1. The cast strip was coiled by the coiler, cooled to room temperature, and bent at angles of 90° and 120°.

Table 7 shows the chemical compositions of the carbon steels having been cast. Table 8 shows the atmospheres within the seal chamber, the cooling rates of the cast strips, the temperatures of the cast strips at the time of sending them from the seal chamber and the cast strip temperatures at the time of coiling. Table 9 shows the thicknesses and compositions of the scale formed on the cast strips, and the peeled states of the scale after working the cast strips. In addition, the exhaust gases within the seal chamber in Table 8 each comprised 11% of $CO_2$, oxygen as shown in the table and the balance nitrogen. Moreover, the compositions of the scale in Table 9 shows $Fe_3O_4$ (%) alone, and the balances (%) are FeO and partly $Fe_2O_3$.

TABLE 7

| No. | C | Si | Mn | S | P | Al | (wt. %) N |
|---|---|---|---|---|---|---|---|
| 20 | 0.006 | 0.02 | 0.03 | 0.015 | 0.018 | 0.018 | 0.0043 |
| 21 | 0.019 | 0.04 | 0.04 | 0.011 | 0.015 | 0.025 | 0.0031 |
| 22 | 0.026 | 0.06 | 0.06 | 0.017 | 0.012 | 0.032 | 0.0051 |
| 23 | 0.025 | 0.08 | 0.07 | 0.013 | 0.013 | 0.023 | 0.0031 |
| 24 | 0.121 | 0.21 | 0.21 | 0.011 | 0.015 | 0.035 | 0.0041 |
| 25 | 0.042 | 0.12 | 0.13 | 0.018 | 0.010 | 0.020 | 0.0041 |
| 26 | 0.056 | 0.18 | 0.15 | 0.012 | 0.012 | 0.022 | 0.0061 |
| 27 | 0.082 | 0.12 | 0.17 | 0.019 | 0.016 | 0.036 | 0.0031 |
| 28 | 0.033 | 0.11 | 0.11 | 0.016 | 0.016 | 0.036 | 0.0021 |
| 29 | 0.152 | 0.52 | 1.33 | 0.023 | 0.013 | 0.023 | 0.0031 |

TABLE 8

| | Within seal chamber | | | | |
|---|---|---|---|---|---|
| | Dew point of exhaust gas (°C.) | $O_2$ (%) | Strip temp. (°C.) | Cooling rate of strip (°C./sec) | Strip temp. during coiling (°C.) |
| Ex. No. 20 | 0 | 5 | 1200 | 10 | *650 |
| Ex. No. 21 | 15 | 4 | 1100 | 13 | *450 |
| Ex. No. 22 | 15 | 4 | 1200 | 10 | 600 |
| Ex. No. 23 | 30 | 3 | 1100 | 15 | 600 |
| Ex. No. 24 | 40 | 1 | 1000 | 15 | 550 |
| Coup. Ex. No. 25 | 28 | #7 | 1000 | 10 | 600 |
| Comp. Ex. No. 26 | 40 | 6 | #1300 | 13 | 600 |
| Comp. Ex. No. 27 | 42 | 5 | 1200 | #7 | 550 |
| Comp. Ex. No. 28 | 0 | #12 | 1000 | 10 | *650 |
| Comp. Ex. No. 29 | 0 | #13 | #1300 | #7 | *450 |

Note:
#The data deviated from the requirements of the present invention.
*The data deviated from the preferred conditions of the present invention.

TABLE 9

| | Cast strip scale | | Bending | |
|---|---|---|---|---|
| | Thickness (μm) | $Fe_3O_4$ (%) | Bending at 90° | Bending at 120° |
| Ex. No. 20 | 7 | 80 | No peeling | Slight rough surface |
| Ex. No. 21 | 6 | 80 | No peeling | Slight rough surface |
| Ex. No. 22 | 7 | 85 | No peeling | No peeling |
| Ex. No. 23 | 7 | 85 | No peeling | No peeling |
| Ex. No. 24 | 6 | 95 | No peeling | No peeling |
| Comp. Ex. No. 25 | 15 | 30 | Slightly peeled | Peeling |
| Comp. Ex. No. 26 | 17 | 35 | Slightly peeled | Peeling |
| Comp. Ex. No. 27 | 18 | 25 | Rough surface | Peeling |
| Comp. Ex. No. 28 | 21 | 20 | Peeling | Peeling |
| Comp. Ex. No. 29 | 23 | 15 | Peeling | Peeling |

The coiling temperatures did not satisfy the preferred conditions of the present invention in Example No. 20 and No. 21 shown in Table 9, and as a result slight rough surfaces were formed when the cast strips were bent at 120°. In Example No. 22 to No. 24, all the experimental conditions satisfied those of the invention, and as a result the scale was not peeled off at all.

In contrast to the above results, at least one of the requirements of the invention in Table 8 was not satisfied in Comparative Example No. 25, No. 26 and No. 28, and as a result the scale was thick, and was peeled off when the cast strips were bent both at 90° and 120°. The cooling rate of the cast strip was inappropriate in Comparative Example No. 27, and consequently a rough surface was formed though the scale was not peeled off when the cast strip was bent at 90°. All the conditions of the invention were not satisfied at all in Comparative Example No. 29. As a result scale containing FeO as its main component was formed, and the scale was peeled off when the cast strip was bent both at 90° and 120°.

Example 4

The eighth aspect to the tenth aspect of the present invention will be explained.

In this example, a nitrogen gas was supplied to the seal chamber 5 to maintain an oxygen gas concentration at up to 5.0% therein using the same machine as in Example 1. A thin cast strip 12 was transferred through the seal chamber 5 by pinch rolls *6a*, *6b* and cooled to up to 1,200° C. in a nitrogen atmosphere therein to form a thin, tight $Fe_3O_4$ scale on the surface.

The thin cast strip 12 sent out of the seal chamber 5 was introduced into the cooling apparatus 7. Many cooling nozzles 8 were arranged on the upper side and the lower side of the thin cast strip 12 therein. The thin cast strip 12 was cooled with pneumatic water ejected from the cooling nozzles 8 through a temperature region to 750° C. at a cooling rate of at least 10° C./sec. Scale formation was thus inhibited after holding the strip in the nitrogen atmosphere, and scale having a thickness up to 10 μm was stably formed.

The thin cast strip 12 sent out of the cooling apparatus 7 was coiled in a coil form by the coiler 9 at temperatures up to 600° C., and thus held at temperatures up to 600° C. for at least 1 hour. FeO scale formation at the interface between the cast strip surface and the scale was inhibited by the holding procedure, and the proportion of $Fe_3O_4$ in the scale was increased.

A carbon steel was cast into a thin cast strip having a thickness of 2.0 to 6.0 mm at a rate of 80 m/sec using the twin drum continuous casting machine as shown in FIG. 1. The cast strip was coiled by the coiler, cooled to room temperature, and bent at angles of 90° and 120°.

Table 10 shows the chemical compositions of the carbon steels having been cast. Table 11 shows the atmospheres within the seal chamber, the cooling rates of the cast strips, the temperatures of the cast strips at the time of sending them out of the seal chamber and the cast strip temperatures at the time of coiling. Table 12 shows the thicknesses and compositions of the scale formed on the cast strips, and the peeled states of the scale after bending the cast strips. In addition, the compositions of the scale in Table 12 shows $Fe_3O_4$ (%) alone, and the balances (%) are almost FeO and partly $Fe_2O_3$.

TABLE 10

| No. | C | Si | Mn | S | P | Cr | Cu | Al | (wt. %) N |
|---|---|---|---|---|---|---|---|---|---|
| 30 | 0.006 | 0.02 | 0.03 | 0.015 | 0.018 | 0.57 | 0.001 | 0.025 | 0.0032 |
| 31 | 0.019 | 0.04 | 0.04 | 0.011 | 0.015 | 0.002 | 0.43 | 0.038 | 0.0043 |
| 32 | 0.026 | 0.06 | 0.06 | 0.017 | 0.012 | 0.39 | 0.001 | 0.043 | 0.0034 |
| 33 | 0.025 | 0.08 | 0.07 | 0.013 | 0.013 | 0.001 | 0.45 | 0.036 | 0.0045 |
| 34 | 0.50 | 0.21 | 0.21 | 0.011 | 0.015 | 0.55 | 0.52 | 0.015 | 0.0052 |
| 35 | 0.042 | 0.12 | 0.13 | 0.018 | 0.010 | 0.75 | 0.001 | 0.037 | 0.0044 |
| 36 | 0.056 | 0.18 | 0.15 | 0.012 | 0.012 | 0.001 | 0.37 | 0.034 | 0.0037 |
| 37 | 0.082 | 0.12 | 0.17 | 0.019 | 0.016 | 0.28 | 0.001 | 0.032 | 0.0035 |
| 38 | 0.033 | 0.11 | 0.11 | 0.016 | 0.016 | 0.13 | 0.33 | 0.031 | 0.0033 |
| 39 | 0.11 | 0.75 | 0.75 | 0.016 | 0.016 | #0.003 | #0.005 | 0.010 | 0.0075 |

Note: #The date deviated from the requirement of the present invention.

TABLE 11

| | Within seal chamber | | Cooling rate | Strip temp. |
|---|---|---|---|---|
| | Atmosphere | Strip temp. (°C.) | of strip (°C./sec) | during coiling (°C.) |
| Ex. No. 30 | $N_2$ ($O_2$; 5%) | 1200 | 10 | *450 |
| Ex. No. 31 | $N_2$ ($O_2$; 7%) | 1100 | 13 | 650 |
| Ex. No. 32 | $N_2$ ($O_2$; 7%) | 1200 | 10 | 600 |
| Ex. No. 33 | $N_2$ ($O_2$; 3%) | 1100 | 15 | 600 |
| Ex. No. 34 | $N_2$ ($O_2$; 1%) | 1000 | 15 | 550 |
| Comp. Ex. No. 35 | #$N_2$ ($O_2$; 7%) | 1200 | 10 | 550 |
| Comp. Ex. No. 36 | $N_2$ ($O_2$; 5%) | #1300 | 13 | 550 |
| Comp. Ex. No. 37 | $N_2$ ($O_2$; 5%) | 1200 | #8 | 600 |
| Comp. Ex. No. 38 | #$N_2$ ($O_2$; 7%) | #1300 | #8 | *650 |
| Comp. Ex. No. 39 | $N_2$ ($O_2$; 7%) | 1200 | 15 | *550 |

Note:
#The data deviated from the requirements of the present invention.
*The data deviated from the preferred conditions of the present invention.

TABLE 12

| | Cast strip scale | | Peeled state of scale | |
|---|---|---|---|---|
| | Thickness (μm) | $Fe_3O_4$ (%) | Bending at 90° | Bending at 120° |
| Ex. No. 30 | 8 | 90 | No peeling | Slight rough surface |
| Ex. No. 31 | 8 | 70 | No peeling | Slight rough surface |
| Ex. No. 32 | 7 | 75 | No peeling | Slight rough surface |
| Ex. No. 33 | 7 | 85 | No peeling | No peeling |
| Ex. No. 34 | 6 | 95 | No peeling | No peeling |
| Comp. Ex. No. 35 | 13 | 30 | Slightly peeled | Almost peeled |
| Comp. Ex. No. 36 | 14 | 35 | Slightly peeled | Almost peeled |
| Comp. Ex. No. 37 | 19 | 20 | Slightly peeled | Almost peeled |
| Comp. Ex. No. 38 | 23 | 25 | Almost peeled | Almost peeled |
| Comp. Ex. No. 39 | 11 | 15 | Slightly peeled | Rough surface |

Since the coiling temperatures of cast strips in Example No. 30 and No. 31 deviated from the preferred conditions, slightly rough surfaces were formed when the strips were bent at 120°. Moreover, since all the conditions were appropriate in Example No. 32 to No. 34, rough surfaces were not formed and the scale was not peeled off.

In contrast to the above results, one of the requirements of the invention was not satisfied in Comparative Example No. 35 to No. 37, and as a result the scale was slightly peeled off when the cast strips were bent at 90°, and almost peeled off when the strips were bent at 120°. Moreover, in Comparative Example No. 38, the experimental conditions deviated from all the conditions of the present invention, the scale was thick, and was almost peeled off when the strip was bent both at 90° and 120°. In Comparative Example No. 39, the contents of Cr and Cu were less. Consequently, the scale was partly peeled off when the strip was bent at 90°, and a rough surface was formed when the strip was bent at 120°.

In addition, although the present invention covers carbon steels containing at least 0.1% of Cu or Cr, even those carbon steels which contain each at least 0.1% of Cu and Cr in total can be expected to exhibit similar effects when the carbon steels satisfy the other requirements of the present invention.

Furthermore, though the cooling rate of the cast strip in a temperature range to 750° C. is restricted to at least 10° C./sec in the present invention, the cooling rate is preferably from 10 to 15° C./sec as practiced in the example.

Furthermore, although the constituents of the cast strip scale are not specifically restricted, the scale preferably contains from 70 to 95% of $Fe_3O_4$ as shown in the example.

INDUSTRIAL APPLICABILITY

The scale of a thin cast strip produced by continuous casting can be made to have a decreased thickness, contain FeO as its main component and exhibit excellent resistance to being peeled off by a combination of holding the cast strip in an Ar gas atmosphere having a controlled oxygen concentration through a strip temperature range to 1,200° C. and cooling the strip at a high rate subsequently to the holding procedure. As a result, there can be produced a cast strip being excellent in the ability of being descaled and having good surface properties. Moreover, the scale of a cast strip can be made to contain $Fe_3O_4$ as its main component by forming a nitrogen atmosphere or exhaust gas atmosphere, holding the cast strip in the atmosphere at temperatures as mentioned above and then cooling at a high rate. As a result, the scale thus formed is difficult to peel off during working the cast strip, and the surface properties of the products can be improved. Since the holding procedure is satisfactory when the strip is held through a temperature region to 1,200° C., the cast strip can be produced efficiently with a small size apparatus using a decreased amount of a gas. The cast strip can, therefore, be produced at low cost.

We claim:

1. In a process for producing a thin cast strip wherein a carbon steel comprising up to 0.5% of C and less than 0.1% of Cr or Cu is cast into a thin cast strip having a thickness up to 10 mm by a continuous casting machine having mold walls which move in synchronization with the cast strip, and the thin cast strip is coiled in a coil form by a coiler, a process for producing a thin cast strip with a reduced surface scale which comprises the steps of holding the thin cast strip, subsequently to casting into the strip in an atmosphere comprising up to 5.0% of oxygen and the balance an inert gas through a temperature region to up to 1,200° C., then cooling the cast strip at a rate of at least 10° C./sec through a temperature region to 800° to 750° C., and coiling the cast strip in a coil form by the coiler.

2. The process for producing a thin cast strip according to claim 1 which has a scale further excellent in the ability of being descaled, wherein Ar is used as the inert gas, and the cast strip is cooled through the temperature region to 800° C. at a rate of at least 10° C./sec, subsequently to the holding procedure in the gas atmosphere.

3. The process for producing a thin cast strip according to claim 1 which has a scale further excellent in the ability of being descaled, wherein Ar is used as the inert gas, the cast strip is cooled through the temperature region to 800° C. at a rate of at least 10° C./sec, subsequently to the holding procedure in the gas atmosphere, and the thin cast strip is coiled in a coil form by the coiler at a coiling temperature of at least 500° C. and up to 800° C.

4. The process for producing a thin cast strip according to claim 1 which has a scale further excellent in press peeling-resistant properties, wherein nitrogen is used as the inert gas, and the cast strip is cooled through a temperature region to 750° C. at a rate of at least 10° C./sec, subsequently to the holding procedure in the gas atmosphere.

5. The process for producing a thin cast strip according to claim 1 which has a scale further excellent in press peeling-resistant properties, wherein nitrogen is used as the inert gas, the cast strip is cooled through a temperature region to 750° C. at a rate of at least 10° C./sec, subsequently to the holding procedure in the gas atmosphere, and the thin cast strip is coiled in a coil form by the coiler at a temperature up to 600° C.

6. The process for producing a thin cast strip according to claim 1 which has a scale further excellent in press peeling-resistant properties, wherein an exhaust gas having a dew point up to 40° C. is used as the inert gas, and the cast strip is cooled through a temperature region to 750° C. at a rate of at least 10° C./sec, subsequently to the holding procedure in the gas atmosphere.

7. The process for producing a thin cast strip according to claim 1 which has a scale further excellent in press peeling-resistant properties, wherein an exhaust gas having a dew point up to 40° C. is used as the inert gas, the cast strip is cooled through a temperature region to 750° C. at a rate of at least 10° C./sec, subsequently to the holding procedure in the gas atmosphere, and the thin cast strip is coiled in a coil form by the coiler at a temperature up to 600° C.

8. In a process for producing a thin cast strip wherein a carbon steel comprising up to 0.5% of C and at least 0.1% of Cr or Cu is cast into a thin cast strip having a thickness up to 10 mm by a continuous casting machine having mold walls which move in synchronization with the cast strip, and the thin cast strip is coiled in a coil form by a coiler, a process for producing a thin cast strip with a reduced surface scale which comprises the steps of holding the thin cast strip, subsequently to casting into the cast strip, in an atmosphere comprising up to 7.0% of oxygen and the balance an inert gas through a temperature region to up to 1,200° C., then cooling the cast strip at a rate of at least 10° C./sec through a temperature region to 750° C., and coiling the cast strip in a coil form by a coiler.

9. The process for producing a thin cast strip according to claim 8 which has a scale further excellent in press peeling-resistant properties, wherein nitrogen is used as the inert gas.

10. The process for producing a thin cast strip according to claim 8 which has a scale further excellent in press peeling-resistant properties, wherein nitrogen is used as the inert gas, and the thin cast strip is coiled in a coil form by the coiler at a temperature up to 600° C.

* * * * *